US008007714B2

(12) United States Patent
Mirchandani et al.

(10) Patent No.: US 8,007,714 B2
(45) Date of Patent: Aug. 30, 2011

(54) EARTH-BORING BITS

(75) Inventors: Prakash K. Mirchandani, Houston, TX (US); Jimmy W. Eason, The Woodlands, TX (US); James J. Oakes, Madison, AL (US); James C. Westhoff, The Woodlands, TX (US); Gabriel B. Collins, Huntsville, AL (US); John H. Stevens, Houston, TX (US); Steven G. Caldwell, Hendersonville, TN (US); Alfred J. Mosco, Spring, TX (US)

(73) Assignees: TDY Industries, Inc., Pittsburgh, PA (US); Baker Hughes Incorporated, Houston, TX (US)

( * ) Notice: Subject to any disclaimer, the term of this patent is extended or adjusted under 35 U.S.C. 154(b) by 470 days.

(21) Appl. No.: 12/033,960

(22) Filed: Feb. 20, 2008

(65) Prior Publication Data

US 2008/0163723 A1 Jul. 10, 2008

Related U.S. Application Data

(60) Division of application No. 11/116,752, filed on Apr. 28, 2005, which is a continuation-in-part of application No. 10/848,437, filed on May 18, 2004.

(60) Provisional application No. 60/566,063, filed on Apr. 28, 2004.

(51) Int. Cl.
*B22F 3/10* (2006.01)

(52) U.S. Cl. ..... 419/10; 419/11; 419/12; 419/13; 419/14; 419/19

(58) Field of Classification Search ..... 419/10–14, 419/19

See application file for complete search history.

(56) References Cited

U.S. PATENT DOCUMENTS

| | | | |
|---|---|---|---|
| 2,299,207 | A | 10/1942 | Bevillard |
| 2,819,958 | A | 1/1958 | Abkowitz et al. |
| 2,819,959 | A | 1/1958 | Abkowitz et al. |
| 2,906,654 | A | 9/1959 | Abkowitz |
| 3,368,881 | A | 2/1968 | Abkowitz et al. |
| 3,471,921 | A | 10/1969 | Feenstra |
| 3,660,050 | A | 5/1972 | Iler et al. |
| 3,757,879 | A | 9/1973 | Wilder et al. |
| 3,942,954 | A | 3/1976 | Frehn |
| 3,987,859 | A | 10/1976 | Lichte |
| 4,017,480 | A | 4/1977 | Baum |
| 4,047,828 | A | 9/1977 | Makely |
| 4,094,709 | A | 6/1978 | Rozmus |
| 4,128,136 | A | 12/1978 | Generoux |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,306,139 | A | 12/1981 | Shinozaki et al. |
| 4,341,557 | A | 7/1982 | Lizenby |
| 4,389,952 | A | 6/1983 | Dreier et al. |
| 4,398,952 | A | 8/1983 | Drake |
| 4,499,048 | A | 2/1985 | Hanejko |
| 4,499,795 | A | 2/1985 | Radtke |
| 4,526,748 | A | 7/1985 | Rozmus |
| 4,547,337 | A | 10/1985 | Rozmus |
| 4,552,232 | A | 11/1985 | Frear |
| 4,554,130 | A | 11/1985 | Ecer |
| 4,562,990 | A | 1/1986 | Rose |
| 4,596,694 | A | 6/1986 | Rozmus |
| 4,597,730 | A | 7/1986 | Rozmus |
| 4,630,693 | A | 12/1986 | Goodfellow |
| 4,656,002 | A | 4/1987 | Lizenby et al. |
| 4,667,756 | A | 5/1987 | King et al. |
| 4,686,080 | A | 8/1987 | Hara et al. |
| 4,694,919 | A | 9/1987 | Barr |
| 4,743,515 | A | 5/1988 | Fischer et al. |
| 4,744,943 | A | 5/1988 | Timm |
| 4,780,274 | A | 10/1988 | Barr |
| 4,804,049 | A | 2/1989 | Barr |

(Continued)

FOREIGN PATENT DOCUMENTS

| | | |
|---|---|---|
| AU | 695583 | 2/1998 |

(Continued)

OTHER PUBLICATIONS

Office Action issued May 7, 2007, in U.S. Appl. No. 10/848,437.

(Continued)

*Primary Examiner* — Roy King
*Assistant Examiner* — Ngoclan T Mai
(74) *Attorney, Agent, or Firm* — TraskBritt

(57) ABSTRACT

The present invention relates to compositions and methods for forming a bit body for an earth-boring bit. The bit body may comprise hard particles, wherein the hard particles comprise at least one of carbide, nitride, boride, oxide, and solid solutions thereof, and a binder binding together the hard particles. The binder may comprise at least one metal selected from cobalt, nickel, and iron and, optionally, at least one melting point reducing constituent selected from a transition metal carbide in the range of 30 to 60 weight percent, boron up to 10 weight percent, silicon up to 20 weight percent, chromium up to 20 weight percent, and manganese up to 25 weight percent, wherein the weight percentages are based on the total weight of the binder. In addition, the hard particles may comprise at least one of (i) cast carbide ($WC+W_2C$) particles, (ii) transition metal carbide particles selected from the carbides of titanium, chromium, vanadium, zirconium, hafnium, tantalum, molybdenum, niobium, and tungsten, and (iii) sintered cemented carbide particles.

35 Claims, 18 Drawing Sheets

U.S. PATENT DOCUMENTS 4,809,903 A 3/1989 Eylon et al.
4,838,366 A 6/1989 Jones
4,871,377 A 10/1989 Frushour
4,884,477 A 12/1989 Smith et al.
4,889,017 A 12/1989 Fuller et al.
4,899,838 A 2/1990 Sullivan et al.
4,919,013 A 4/1990 Smith et al.
4,923,512 A 5/1990 Timm et al.
4,956,012 A 9/1990 Jacobs et al.
4,968,348 A 11/1990 Abkowitz et al.
4,991,670 A 2/1991 Fuller et al.
5,000,273 A 3/1991 Horton et al.
5,030,598 A 7/1991 Hsieh
5,032,352 A 7/1991 Meeks et al.
5,049,450 A 9/1991 Dorfman et al.
5,090,491 A 2/1992 Tibbitts et al.
5,092,412 A 3/1992 Walk
5,161,898 A 11/1992 Drake
5,232,522 A 8/1993 Doktycz et al.
5,281,260 A 1/1994 Kumar et al.
5,286,685 A 2/1994 Schoennahl et al.
5,311,958 A 5/1994 Isbell et al.
5,348,806 A 9/1994 Kojo et al.
5,373,907 A 12/1994 Weaver
5,433,280 A 7/1995 Smith
5,443,337 A 8/1995 Katayama
5,452,771 A 9/1995 Blackman et al.
5,479,997 A 1/1996 Scott et al.
5,482,670 A 1/1996 Hong
5,484,468 A 1/1996 Ostlund et al.
5,506,055 A 4/1996 Dorfman et al.
5,518,077 A 5/1996 Blackman et al.
5,525,134 A 6/1996 Mehrotra et al.
5,543,235 A 8/1996 Mirchandani et al.
5,544,550 A 8/1996 Smith
5,560,440 A 10/1996 Tibbitts
5,586,612 A 12/1996 Isbell et al.
5,593,474 A 1/1997 Keshavan et al.
5,611,251 A 3/1997 Katayama
5,612,264 A 3/1997 Nilsson et al.
5,641,251 A 6/1997 Leins et al.
5,641,921 A 6/1997 Dennis et al.
5,662,183 A * 9/1997 Fang ..... 175/374
5,666,864 A 9/1997 Tibbitts
5,677,042 A 10/1997 Massa et al.
5,679,445 A 10/1997 Massa et al.
5,697,046 A 12/1997 Conley
5,697,462 A 12/1997 Grimes et al.
5,732,783 A 3/1998 Truax et al.
5,733,649 A 3/1998 Kelley et al.
5,733,664 A 3/1998 Kelley et al.
5,753,160 A 5/1998 Takeuchi et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,830,256 A 11/1998 Northrop et al.
5,856,626 A 1/1999 Fischer et al.
5,865,571 A 2/1999 Tankala et al.
5,880,382 A 3/1999 Fang et al.
5,897,830 A 4/1999 Abkowitz et al.
5,957,006 A 9/1999 Smith
5,963,775 A 10/1999 Fang
6,029,544 A 2/2000 Kalayama
6,051,171 A 4/2000 Takeuchi et al.
6,063,333 A 5/2000 Dennis
6,068,070 A 5/2000 Scott
6,073,518 A 6/2000 Chow et al.
6,086,980 A 7/2000 Foster et al.
6,089,123 A 7/2000 Chow et al.
6,109,377 A * 8/2000 Massa et al. ..... 175/417
6,135,218 A 10/2000 Deane et al.
6,148,936 A 11/2000 Evans et al.
6,200,514 B1 3/2001 Meister
6,209,420 B1 * 4/2001 Butcher et al. ..... 76/108.2
6,214,134 B1 4/2001 Eylon et al.
6,214,287 B1 4/2001 Waldenstrom
6,220,117 B1 4/2001 Butcher et al.
6,227,188 B1 5/2001 Tankala et al.
6,228,139 B1 5/2001 Oskarsson
6,241,036 B1 6/2001 Lovato et al.
6,254,658 B1 7/2001 Taniuchi et al.
6,287,360 B1 9/2001 Kembalyan et al.
6,290,438 B1 9/2001 Papajewski
6,293,986 B1 9/2001 Rodiger et al.
6,302,224 B1 * 10/2001 Sherwood, Jr. ..... 175/397
6,353,771 B1 3/2002 Southland
6,372,346 B1 4/2002 Toth
6,375,706 B2 4/2002 Kembaiyan et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,474,425 B1 11/2002 Truax et al.
6,500,226 B1 12/2002 Dennis
6,511,265 B1 1/2003 Mirchandani et al.
6,576,182 B1 6/2003 Ravagni et al.
6,589,640 B2 7/2003 Griffin et al.
6,599,467 B1 7/2003 Yamaguchi et al.
6,607,693 B1 8/2003 Saito et al.
6,655,481 B2 12/2003 Findley et al.
6,655,882 B2 * 12/2003 Heinrich et al. ..... 408/144
6,685,880 B2 2/2004 Engstrom et al.
6,742,608 B2 6/2004 Murdoch
6,742,611 B1 6/2004 Illerhaus et al.
6,756,009 B2 6/2004 Sim et al.
6,766,870 B2 7/2004 Overstreet
6,849,231 B2 2/2005 Kojima et al.
6,918,942 B2 7/2005 Hatta et al.
7,044,243 B2 5/2006 Kembaiyan et al.
7,048,081 B2 5/2006 Smith et al.
7,250,069 B2 7/2007 Kembaiyan et al.
7,261,782 B2 8/2007 Hwang et al.
7,270,679 B2 9/2007 Istephanous et al.
7,556,668 B2 7/2009 Eason et al.
7,661,491 B2 2/2010 Kembaiyan et al.
7,687,156 B2 3/2010 Fang
2002/0004105 A1 1/2002 Kunze et al.
2002/0020564 A1 * 2/2002 Fang et al. ..... 175/374
2002/0175006 A1 11/2002 Findley et al.
2003/0010409 A1 1/2003 Kunze et al.
2003/0041922 A1 3/2003 Hirose et al.
2003/0219605 A1 11/2003 Molian et al.
2004/0013558 A1 1/2004 Kondoh et al.
2004/0060742 A1 4/2004 Kembaiyan et al.
2004/0149494 A1 * 8/2004 Kembaiyan et al. ..... 175/374
2004/0196638 A1 10/2004 Lee et al.
2004/0243241 A1 12/2004 Istephanous et al.
2004/0244540 A1 * 12/2004 Oldham et al. ..... 76/108.2
2004/0245022 A1 12/2004 Izaguirre et al.
2004/0245024 A1 12/2004 Kembalyan
2005/0008524 A1 1/2005 Testani
2005/0072496 A1 4/2005 Hwang et al.
2005/0084407 A1 4/2005 Myrick
2005/0117984 A1 6/2005 Eason et al.
2005/0126334 A1 6/2005 Mirchandani
2005/0211475 A1 9/2005 Mirchandani et al.
2005/0247491 A1 11/2005 Mirchandani et al.
2005/0268746 A1 12/2005 Abkowitz et al.
2006/0016521 A1 1/2006 Hanusiak et al.
2006/0032335 A1 * 2/2006 Kembaiyan ..... 76/108.1
2006/0032677 A1 2/2006 Azar et al.
2006/0043648 A1 3/2006 Takeuchi et al.
2006/0057017 A1 3/2006 Woodfield et al.
2006/0131081 A1 6/2006 Mirchandani et al.
2007/0042217 A1 2/2007 Fang et al.
2007/0102198 A1 5/2007 Oxford et al.
2007/0102199 A1 5/2007 Smith et al.
2007/0102200 A1 5/2007 Choe et al.
2007/0102202 A1 5/2007 Choe et al.
2007/0193782 A1 8/2007 Fang et al.

FOREIGN PATENT DOCUMENTS

| | | | |
|---|---|---|---|
| CA | 2212197 | | 10/2000 |
| EP | 0264674 | A2 | 4/1988 |
| EP | 0453428 | A1 | 10/1991 |
| EP | 0995876 | A2 | 4/2000 |
| EP | 1244531 | B1 | 10/2004 |
| GB | 945227 | | 12/1963 |
| GB | 2385350 | A | 8/2003 |
| GB | 2393449 | A | 3/2004 |
| JP | 5-064288 | U | 8/1993 |
| JP | 10219385 | A | 8/1998 |
| UA | 6742 | | 12/1994 |
| UA | 63469 | | 1/2006 |
| UA | 23749 | U | 11/2007 |
| WO | 03049889 | A2 | 6/2003 |
| WO | 2004053197 | A2 | 6/2004 |

OTHER PUBLICATIONS

Office Action issued May 29, 2007, in U.S. Appl. No. 11/116,752.
US 4,966,627, 10/1990, Keshavan et al. (withdrawn)

* cited by examiner

EARTH-BORING BITS

CROSS-REFERENCE TO RELATED APPLICATIONS

This application is a divisional of U.S. patent application Ser. No. 11/116,752, filed Apr. 28, 2005, now U.S. Pat. No. 7,954,569, issued Jun. 7, 2011, which application claims priority as a continuation-in-part to U.S. patent application Ser. No. 10/848,437, filed May 18, 2004, pending, which claims priority from U.S. Provisional Application Ser. No. 60/566,063 filed Apr. 28, 2004.

TECHNICAL FIELD

This invention relates to improvements to earth-boring bits and methods of producing earth-boring bits. More specifically, the invention relates to earth-boring bit bodies, roller cones, insert roller cones, cones and teeth for roller cone earth-boring bits and methods of forming earth-boring bit bodies, roller cones, insert roller cones, cones and teeth for roller cone earth-boring bits.

BACKGROUND

Earth-boring bits may have fixed or rotatable cutting elements. Earth-boring bits with fixed cutting elements typically include a bit body machined from steel or fabricated by infiltrating a bed of hard particles, such as cast carbide (WC+$W_2C$), tungsten carbide (WC), and/or sintered cemented carbide with a binder such as, for example, a copper-based alloy. Several cutting inserts are fixed to the bit body in predetermined positions to optimize cutting. The bit body may be secured to a steel shank that typically includes a threaded pin connection by which the bit is secured to a drive shaft of a downhole motor or a drill collar at the distal end of a drill string.

Steel-bodied bits are typically machined from round stock to a desired shape, with topographical and internal features. Hardfacing techniques may be used to apply wear-resistant materials to the face of the bit body and other critical areas of the surface of the bit body.

In the conventional method for manufacturing a bit body from hard particles and a binder, a mold is milled or machined to define the exterior surface features of the bit body. Additional hand milling or clay work may also be required to create or refine topographical features of the bit body.

Once the mold is complete, a preformed bit blank of steel may be disposed within the mold cavity to internally reinforce the bit body and provide a pin attachment matrix upon fabrication. Other sand, graphite, transition- or refractory- metal-based inserts, such as those defining internal fluid courses, pockets for cutting elements, ridges, lands, nozzle displacements, junk slots, or other internal or topographical features of the bit body, may also be inserted into the cavity of the mold. Any inserts used must be placed at precise locations to ensure proper positioning of cutting elements, nozzles, junk slots, etc., in the final bit.

The desired hard particles may then be placed within the mold and packed to the desired density. The hard particles are then infiltrated with a molten binder, which freezes to form a solid bit body including a discontinuous phase of hard particles within a continuous phase of binder.

The bit body may then be assembled with other earth-boring bit components. For example, a threaded shank may be welded or otherwise secured to the bit body, and cutting elements or inserts (typically cemented tungsten carbide, or diamond or a synthetic polycrystalline diamond compact ("PDC")) are secured within the cutting insert pockets, such as by brazing, adhesive bonding, or mechanical affixation. Alternatively, the cutting inserts may be bonded to the face of the bit body during furnacing and infiltration if thermally stable PDCs ("TSPs") are employed.

Rotatable earth-boring bits for oil and gas exploration conventionally comprise cemented carbide cutting inserts attached to cones that form part of a roller-cone assembled bit or comprise milled teeth formed in the cutter by machining. The milled teeth are typically hardfaced with tungsten carbide in an alloy steel matrix. The bit body of the roller cone bit is usually made of alloy steel.

Earth-boring bits typically are secured to the terminal end of a drill string, which is rotated from the surface or by mud motors located just above the bit on the drill string. Drilling fluid or mud is pumped down the hollow drill string and out nozzles formed in the bit body. The drilling fluid or mud cools and lubricates the bit as it rotates and also carries material cut by the bit to the surface.

The bit body and other elements of earth-boring bits are subjected to many forms of wear as they operate in the harsh downhole environment. Among the most common form of wear is abrasive wear caused by contact with abrasive rock formations. In addition, the drilling mud, laden with rock cuttings, causes erosive wear on the bit.

The service life of an earth-boring bit is a function not only of the wear properties of the PDCs or cemented carbide inserts, but also of the wear properties of the bit body (in the case of fixed cutter bits) or cones (in the case of roller cone bits). One way to increase earth-boring bit service life is to employ bit bodies or cones made of materials with improved combinations of strength, toughness, and abrasion/erosion resistance.

Accordingly, there is a need for improved bit bodies for earth-boring bits having increased wear resistance, strength and toughness.

SUMMARY OF THE INVENTION

The present invention relates to a composition for forming a bit body for an earth-boring bit. The bit body comprises hard particles, wherein the hard particles comprise at least one of carbides, nitrides, borides, silicides, oxides, and solid solutions thereof, and a binder binding together the hard particles. The hard particles may comprise at least one transition metal carbide selected from carbides of titanium, chromium, vanadium, zirconium, hafnium, tantalum, molybdenum, niobium, and tungsten or solid solutions thereof. The hard particles may be present as individual or mixed carbides and/or as sintered cemented carbides. Embodiments of the binder may comprise at least one metal selected from cobalt, nickel, iron and alloys thereof. In a further embodiment, the binder may further comprise at least one melting point reducing constituent selected from a transition metal carbide up to 60 weight percent, one or more transition metals up to 50 weight percent, carbon up to 5 weight percent, boron up to 10 weight percent, silicon up to 20 weight percent, chromium up to 20 weight percent, and manganese up to 25 weight percent, wherein the weight percentages are based on the total weight of the binder. In one embodiment, the binder comprises 40 to 50 weight percent of tungsten carbide and 40 to 60 weight percent of at least one of iron, cobalt, and nickel. For the purpose of this invention, transition elements are defined as those belonging to groups IVB, VB, and VIB of the periodic table.

Another embodiment of the composition for forming a matrix body comprises hard particles and a binder, wherein the binder has a melting point in the range of 1050° C. to 1350° C. The binder may be an alloy comprising at least one of iron, cobalt, and nickel and may further comprise at least one of a transition metal carbide, a transition element, carbon, boron, silicon, chromium, manganese, silver, aluminum, copper, tin, and zinc. More preferably, the binder may be an alloy comprising at least one of iron, cobalt, and nickel and at least one of tungsten carbide, tungsten, carbon, boron, silicon, chromium, and manganese.

A further embodiment of the invention is a composition for forming a matrix body, the composition comprising hard particles of a transition metal carbide and a binder comprising at least one of nickel, iron, and cobalt and having a melting point less than 1350° C. The binder may further comprise at least one of a transition metal carbide, tungsten carbide, tungsten, carbon, boron, silicon, chromium, manganese, silver, aluminum, copper, tin, and zinc.

In the manufacture of bit bodies, hard particles and, optionally, inserts may be placed within a bit body mold. The inserts may be incorporated into the articles of the present invention by any method. For example, the inserts may be added to the mold before filling the mold with the powdered metal or hard particles and any inserts present may be infiltrated with a molten binder, which freezes to form a solid matrix body including a discontinuous phase of hard particles within a continuous phase of binder. Embodiments of the present invention also include methods of forming articles, such as, but not limited to, bit bodies for earth-boring bits, roller cones, and teeth for rolling cone drill bits. An embodiment of the method of forming an article may comprise infiltrating a mass of hard particles comprising at least one transition metal carbide with a binder comprising at least one of nickel, iron, and cobalt and having a melting point less than 1350° C. Another embodiment includes a method comprising infiltrating a mass of hard particles comprising at least one transition metal carbide with a binder having a melting point in the range of 1050° C. to 1350° C. The binder may comprise at least one of iron, nickel, and cobalt, wherein the total concentration of iron, nickel, and cobalt is from 40 to 99 weight percent by weight of the binder. The binder may further comprise at least one of a selected transition metal carbide, tungsten carbide, tungsten, carbon, boron, silicon, chromium, manganese, silver, aluminum, copper, tin, and zinc in a concentration effective to reduce the melting point of the iron, nickel, and/or cobalt. The binder may be a eutectic or near-eutectic mixture. The lowered melting point of the binder facilitates proper infiltration of the mass of hard particles.

A further embodiment of the invention is a method of producing an earth-boring bit, comprising casting the earth-boring bit from a molten mixture of at least one of iron, nickel, and cobalt and a carbide of a transition metal. The mixture may be a eutectic or near-eutectic mixture. In these embodiments, the earth-boring bit may be cast directly without infiltrating a mass of hard particles.

Unless otherwise indicated, all numbers expressing quantities of ingredients, time, temperatures, and so forth used in the present specification and claims are to be understood as being modified in all instances by the term "about." Accordingly, unless indicated to the contrary, the numerical parameters set forth in the following specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviations found in their respective testing measurements.

The reader will appreciate the foregoing details and advantages of the present invention, as well as others, upon consideration of the following detailed description of embodiments of the invention. The reader also may comprehend such additional details and advantages of the present invention upon making and/or using embodiments within the present invention.

BRIEF DESCRIPTION OF THE DRAWINGS

The features and advantages of the present invention may be better understood by reference to the accompanying figures in which.

DETAILED DESCRIPTION OF THE INVENTION

Embodiments of the present invention relate to a composition for the formation of bit bodies for earth-boring bits, roller cones, insert roller cones, cones and teeth for roller cone drill bits and methods of making a bit body for such articles. Additionally, the method may be used to make other articles. Certain embodiments of a bit body of the present invention comprise at least one discontinuous hard phase and a continuous binder phase binding together the hard phase. Embodiments of the compositions and methods of the present invention provide increased service life for the bit body, roller cones, insert roller cones, teeth, and cones produced from the composition and method and thereby improve the service life of the earth-boring bit or other tool. The body material of the bit body, roller cone, insert roller cone, or cone provides the overall properties to each region of the article.

Figure 1:
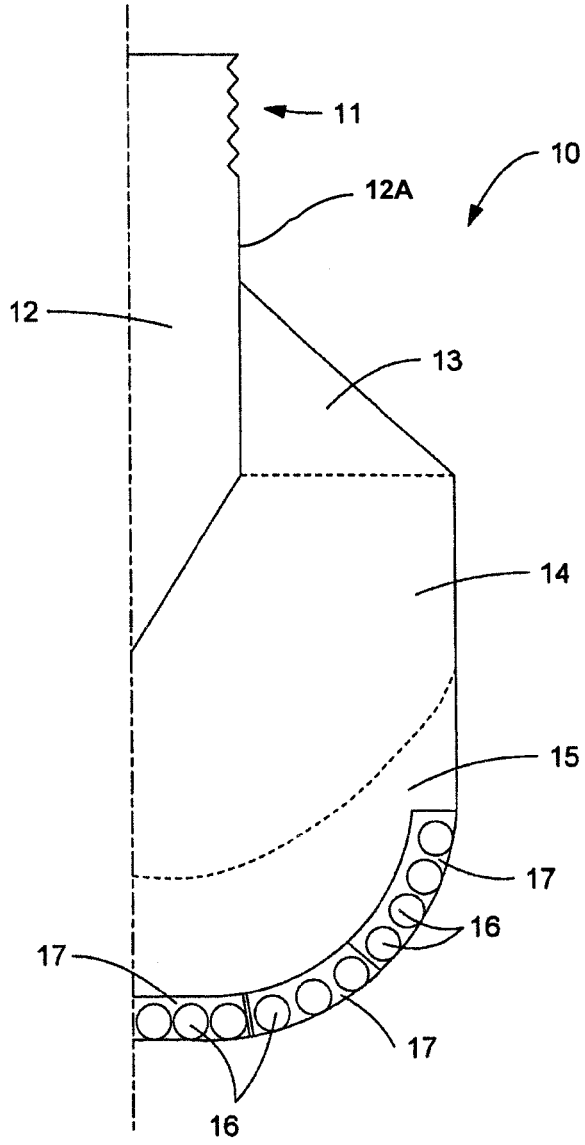
FIG. 1 is a schematic cross-sectional view of an embodiment of a bit body for an earth-boring bit.

A typical bit body 10 of a fixed cutter earth-boring bit is shown in FIG. 1. Generally, a bit body 10 comprises attachment means 11 on a shank 12 and blank region 12A incorporated in the bit body 10. The shank 12, blank region 12A, and a pin may each independently be made of an alloy of steels or at least one discontinuous hard phase and a continuous binder phase, and the attachment means 11, shank 12, and blank region 12A may be attached to the bit body 10 by any method such as, but not limited to, brazed, threaded connections, pins, keyways, shrink fits, adhesives, diffusion bonding, interference fits, or any other mechanical or chemical connection. However, in embodiments of the present invention, the shank 12 including the attachment means 11 may be made from an alloy steel or the same or different composition of hard particles in a binder as other portions of the bit body 10. As such, the bit body 10 may be constructed having various regions, and each region may comprise a different concentration, composition, and crystal size of hard particles or binder, for example. This allows tailoring the properties in specific regions of the article as desired for a particular application. As such, the article may be designed so the properties or composition of the regions may change abruptly or more gradually between different regions of the article. The example bit body 10 of FIG. 1 comprises three regions. For example, the top region 13 may comprise a discontinuous hard phase of tungsten and/or tungsten carbide, the midsection 14 may comprise a discontinuous hard phase of coarse cast tungsten carbide ($W_2C$, WC), tungsten carbide, and/or sintered cemented carbide particles, and the bottom region 15, if present, may comprise a discontinuous hard phase of fine cast carbide, tungsten carbide, and/or sintered cemented carbide particles. The bit body 10 also includes pockets 16 along the bottom of the bit body 10 and into which cutting inserts may be disposed. The pockets 16 may be incorporated directly in the bit body 10 by the mold, by machining the green or brown billet, as inserts, for example, incorporated during bit body fabrication, or as inserts attached after the bit body 10 is completed by brazing or other attachment method, as described above, for example. The bit body 10 may also include internal fluid courses, ridges, lands, nozzles, junk slots, and any other conventional topographical features of an earth-boring bit body. Optionally, these topographical features may be defined by preformed inserts, such as inserts 17 that are located at suitable positions on the bit body mold. Embodiments of the present invention include bit bodies comprising cemented carbide inserts. In a conventional bit body, the hard phase particles are bound in a matrix of a copper-based alloy, such as brass or bronze. Embodiments of the bit body of the present invention may comprise or be fabricated with new binders to import improved wear resistance, strength and toughness to the bit body.

The manufacturing process for hard particles in a binder typically involves consolidating metallurgical powder (typically a particulate ceramic and binder metal) to form a green billet. Powder consolidation processes using conventional techniques may be used, such as mechanical or hydraulic pressing in rigid dies, and wet-bag or dry-bag isostatic pressing. The green billet may then be presintered or fully sintered to further consolidate and densify the powder. Presintering results in only a partial consolidation and densification of the part. A green billet may be presintered at a lower temperature than the temperature to be reached in the final sintering operation to produce a presintered billet ("brown billet"). A brown billet has relatively low hardness and strength as compared to the final fully sintered article, but significantly higher than the green billet. During manufacturing, the article may be machined as a green billet, brown billet, or as a fully sintered article. Typically, the machinability of a green or brown billet is substantially easier than the machinability of the fully sintered article. Machining a green billet or a brown billet may be advantageous if the fully sintered part is difficult to machine or would require grinding to meet the required dimensional final tolerances rather than machining. Other means to improve machinability of the part may also be employed, such as addition of machining agents to close the porosity of the billet; a typical machining agent is a polymer. Finally, sintering at liquid phase temperature in conventional vacuum furnaces or at high pressures in a SinterHip furnace may be carried out. The billet may be over-pressure sintered at a pressure of 300 psi to 2000 psi and at a temperature of 1350° C. to 1500° C. Presintering and sintering of the billet causes removal of lubricants, oxide reduction, densification, and microstructure development. As stated above, subsequent to sintering, the bit body, roller cone, insert roller cone or cone may be further appropriately machined or grinded to form the final configuration.

The present invention also includes a method of producing a bit body, roller cone, insert roller cone or cone with regions of different properties or compositions. An embodiment of the method includes placing a first metallurgical powder into a first region of a void within a mold and second metallurgical powder in a second region of the void of the mold. In some embodiments, the mold may be segregated into the two or more regions by, for example, placing a physical partition, such as paper or a polymeric material, in the void of the mold to separate the regions. The metallurgical powders may be chosen to provide, after consolidation and sintering, cemented carbide materials having the desired properties as described above. In another embodiment, a portion of at least the first metallurgical powder and the second metallurgical powder are placed in contact, without partitions, within the mold. A wax or other binder may be used with the metallurgical powders to help form the regions without use of physical partitions.

An article with a gradient change in properties or composition may also be formed by, for example, placing a first metallurgical powder in a first region of a mold. A second portion of the mold may then be filled with a metallurgical powder comprising a blend of the first metallurgical powder and a second metallurgical powder. The blend would result in an article having at least one property between the same property in an article formed by the first and second metallurgical powder independently. This process may be repeated until the desired composition gradient or compositional structure is complete in the mold and, typically, would end with filling a region of the mold with the second metallurgical powder. Embodiments of this process may also be performed with or without physical partitions. Additional regions may be filled with different materials, such as a third metallurgical powder or even a previously copper alloy infiltrated article. The mold may then be isostatically compressed to consolidate the metallurgical powders to form a billet. The billet is subsequently sintered to further densify the billet and to form an autogenous bond between the regions.

Any binder may be used, as previously described, such as nickel, cobalt, iron and alloys of nickel, cobalt, and iron. Additionally, in certain embodiments, the binder used to fabricate the bit body may have a melting point between 1050° C. and 1350° C. As used herein, the melting point or the melting temperature is the solidus of the particular composition. In other embodiments, the binder comprises an alloy of at least one of cobalt, iron, and nickel, wherein the alloy has a melting point of less than 1350° C. In other embodiments of the composition of the present invention, the composition comprises at least one of cobalt, nickel, and iron and a melting point reducing constituent. Pure cobalt, nickel, and iron are characterized by high melting points (approximately 1500° C.) and, hence, the infiltration of beds of hard particles by pure molten cobalt, iron, or nickel is difficult to accomplish in a practical manner without formation of excessive porosity or undesirable phases. However, an alloy of at least one of cobalt, iron, or nickel may be used if it includes a sufficient amount of at least one melting point reducing constituent. The melting point reducing constituent may be at least one of a transition metal carbide, a transition element, tungsten, carbon, boron, silicon, chromium, manganese, silver, aluminum, copper, tin, zinc, as well as other elements that alone or in combination can be added in amounts that reduce the melting point of the binder sufficiently so that the binder may be used effectively to form a bit body by the selected method. A binder may effectively be used to form a bit body if the binder's properties, for example, melting point, molten viscosity, and infiltration distance, are such that the bit body may be cast without an excessive amount of porosity. Preferably, the melting point reducing constituent is at least one of a transition metal carbide, a transition metal, tungsten, carbon, boron, silicon, chromium and manganese. It may be preferable to combine two or more of the above melting point reducing constituents to obtain a binder effective for infiltrating a mass of hard particles. For example, tungsten and carbon may be added together to produce a greater melting point reduction than produced by the addition of tungsten alone and, in such a case, the tungsten and carbon may be added in the form of tungsten carbide. Other melting point reducing constituents may be added in a similar manner.

The one or more melting point reducing constituents may be added alone or in combination with other binder constituents in any amount that produces a binder composition effective for producing a bit body. In addition, the one or more melting point reducing constituents may be added such that the binder is a eutectic or near-eutectic composition. Providing a binder with eutectic or near-eutectic concentration of ingredients ensures that the binder will have a lower melting point, which may facilitate casting and infiltrating the bed of hard particles. In certain embodiments, it is preferable for the one or more melting point reducing constituents to be present in the binder in the following weight percentages based on the total binder weight: tungsten may be present up to 55%, carbon may be present up to 4%, boron may be present up to 10%, silicon may be present up to 20%, chromium may be present up to 20%, and manganese may be present up to 25%. In certain other embodiments, it may be preferable for the one or more melting point reducing constituents to be present in the binder in one or more of the following weight percentages based on the total binder weight: tungsten may be present from 30 to 55%, carbon may be present from 1.5 to 4%, boron may be present from 1 to 10%, silicon may be present from 2 to 20%, chromium may be present from 2 to 20%, and manganese may be present from 10 to 25%. In certain other embodiments of the composition of the present invention, the melting point reducing constituent may be tungsten carbide present from 30 to 60 weight %. Under certain casting conditions and binder concentrations, all or a portion of the tungsten carbide will precipitate from the binder upon freezing and will form a hard phase. This precipitated hard phase may be in addition to any hard phase present as hard particles in the mold. However, if no hard particles are disposed in the mold or in a section of the mold, all of the hard phase particles in the bit body or in the section of the bit body may be formed as tungsten carbide precipitated during casting.

Embodiments of the articles of the present invention may include 50% or greater volumes of hard particles or hard phase; in certain embodiments, it may be preferable for the hard particles or hard phase to comprise between 50 and 80 volume % of the article; more preferably, for such embodiments, the hard phase may comprise between 60 and 80 volume % of the article. As such, in certain embodiments, the binder phase may comprise less than 50 volume % of the article, or preferably between 20 and 50 volume % of the article. In certain embodiments, the binder may comprise between 20 and 40 volume % of the article.

Embodiments of the present invention also comprise bit bodies for earth-boring bits and other articles comprising transition metal carbides wherein the bit body comprises a volume fraction of tungsten carbide greater than 75 volume %. It is now possible to prepare bit bodies having such a volume fraction of, for example, tungsten carbide, due to the method of the present invention, embodiments of which are described below. An embodiment of the method comprises infiltrating a bed of tungsten carbide hard particles with a binder that is a eutectic or near-eutectic composition of at least one of cobalt, iron, and nickel and tungsten carbide. It is believed that bit bodies comprising concentrations of discontinuous phase tungsten carbide of up to 95% by volume may be produced by methods of the present invention if a bed of tungsten is infiltrated with a molten eutectic or near-eutectic composition of tungsten carbide and at least one of cobalt, iron, and nickel. In contrast, conventional infiltration methods for producing bit bodies may only be used to produce bit bodies having a maximum of about 72% by volume tungsten carbide. The inventors have determined that the volume concentration of tungsten carbide in the cast bit body and other articles can be 75% up to 95% if using, as infiltrated, a eutectic or near-eutectic composition of tungsten carbide and at least one of cobalt, iron, and nickel. Presently, there are limitations in the volume percentage of hard phase that may be formed in a bit body due to limitations in the packing density of a mold with hard particles and the difficulties in infiltrating a densely packed mass of hard particles. However, precipitating carbide from an infiltrant binder comprising a eutectic or near-eutectic composition avoids these difficulties. Upon freezing of the binder in the bit body mold, the additional hard phase is formed by precipitation from the molten infiltrant during cooling. Therefore, a greater concentration of hard phase is formed in the bit body than could be achieved if the molten binder lacks dissolved tungsten carbide. Use of molten binder/infiltrant compositions at or near the eutectic allows higher volume percentages of hard phase in bit bodies and other articles than previously available.

The volume percent of tungsten carbide in the bit body may be additionally increased by incorporating cemented carbide inserts into the bit body. The cemented carbide inserts may be used for forming internal fluid courses, pockets for cutting elements, ridges, lands, nozzle displacements, junk slots, or other topographical features of the bit body, or merely to provide structural support, stiffness, toughness, strength, or wear resistance at selected locations within the bit body or holder. Conventional cemented carbide inserts may comprise from 70 to 99 volume % of tungsten carbide if prepared by conventional cemented carbide techniques. Any known cemented carbide may be used as inserts in the bit body, such as, but not limited to, composites of carbides of at least one of titanium, zirconium, hafnium, vanadium, niobium, tantalum, chromium, molybdenum and tungsten in a binder of at least one of cobalt, iron, and nickel. Additional alloying agents may be present in the cemented carbides as are known in the art.

Embodiments of the composition for forming a bit body also comprise at least one hard particle type. As stated above, the bit body may also comprise various regions comprising different types and/or concentrations of hard particles. For example, bit body 10 of FIG. 1 may comprise a bottom region 15 of a harder wear-resistant discontinuous hard phase material with a fine particle size and a midsection 14 of a tougher discontinuous hard phase material with a relatively coarse particle size. The hard phase or hard particles of any section may comprise at least one carbide, nitride, boride, oxide, cast carbide, cemented carbide, mixtures thereof, and solid solutions thereof. In certain embodiments, the hard phase may comprise at least one cemented carbide comprising at least one of titanium, zirconium, hafnium, vanadium, niobium, tantalum, chromium, molybdenum, and tungsten. The cemented carbides may have any suitable particle size or shape, such as, but not limited to, irregular, spherical, oblate and prolate shapes.

Cemented carbide grades with tungsten carbide in a cobalt binder have a commercially attractive combination of strength, fracture toughness and wear resistance. "Strength" is the stress at which a material ruptures or fails. "Toughness" is the ability of a material to absorb energy and deform plastically before fracturing. Toughness is proportional to the area under the stress-strain curve from the origin to the breaking point. See McGraw-Hill Dictionary of Scientific and Technical Terms ($5^{th}$ ed. 1994). "Wear resistance" is the ability of a material to withstand damage to its surface. Wear generally involves progressive loss of material, due to a relative motion between a material and a contacting surface or substance. See Metals Handbook Desk Edition (2d ed. 1998). "Fracture Toughness" is the critical stress at a crack tip necessary to propagate that crack and is usually characterized by the "critical stress intensity factor" ($K_{ic}$).

The strength, toughness and wear resistance of a cemented carbide are related to the average grain size of the dispersed hard phase and the volume (or weight) fraction of the binder phase present in the conventional cemented carbide. Generally, an increase in the average grain size of tungsten carbide and/or an increase in the volume fraction of the cobalt binder will result in an increase in fracture toughness. However, this increase in toughness is generally accompanied by a decrease in wear resistance. The cemented carbide metallurgist is thus challenged to develop cemented carbides with both high wear resistance and high fracture toughness while attempting to design grades for demanding applications.

Figure 14:
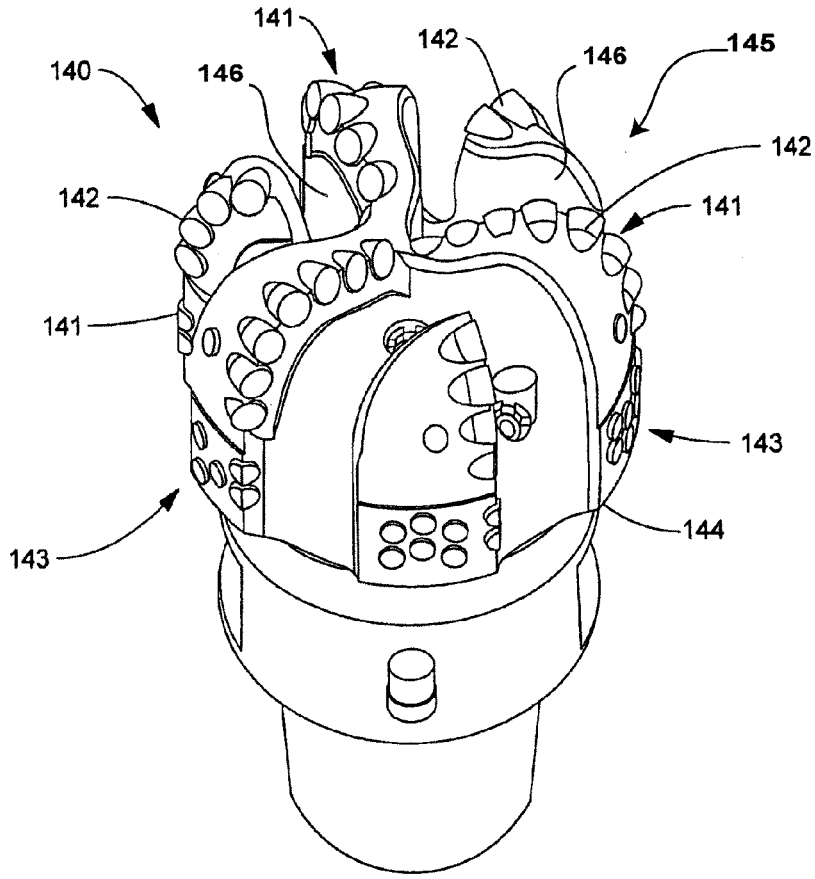
FIG. 14 is a representation of an embodiment of a bit body of the present invention.

The bit body 140 of FIG. 14 may include sections comprising different concentrations or compositions of components to provide various properties to specific locations within the bit body 140, such as wear resistance, toughness, or corrosion resistance. For example, the insert pocket regions 141 in the area around the drill bit cutting inserts 142, the gage pad 143, or nozzle outlet region 144, a roller cone blade region, or the exterior of the crown 145 may comprise a more wear-resistant material. In addition, embodiments of the bit body of the present invention may have regions of high toughness, such as in the internal region of a blade 146, an internal region of a roller cone, at least an internal region of the shank or a pin, or a region adjacent to the shank. The properties of different regions of the bit body, roller cone, insert roller cone, or cone may also be tailored to provide a region that is more easily machined or corrosion resistant, for example.

Embodiments of the bit body, roller cone, insert roller cone, or cone may comprise unique properties that may not be achieved in conventional bit bodies, roller cones, insert roller cones, and cones. Samples of compositions suitable for the present invention were produced for testing. The nominal compositions of the test samples are shown in Table 1 below.

TABLE 1

| Sample | Cobalt wt % | Nickel wt % | WC wt % |
|---|---|---|---|
| FL-25 | 15 | 10 | bal. |
| FL-30 | 18 | 12 | bal. |
| FL-35 | 21 | 14 | bal. |

As can be seen from Table 2, embodiments of the present invention comprise body materials having transverse rupture strength greater than 300 ksi. Conventional bit bodies comprising body materials of steel or hard particles infiltrated with brass or bronze do not have transverse rupture strengths as high as the embodiments of the present invention.

Figure 15A:
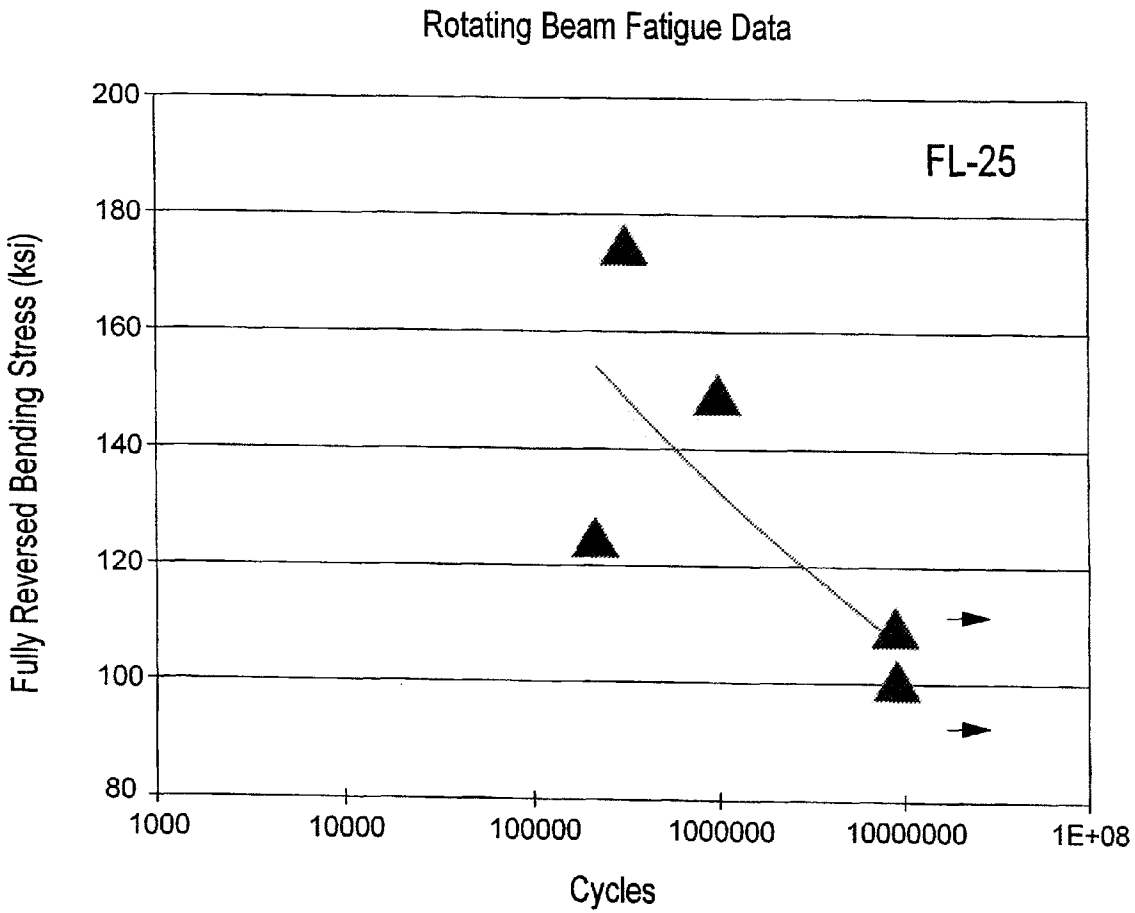
FIGS. 15*a*, 15*b* and 15*c* are graphs of Rotating Beam Fatigue Data for compositions that could be used in embodiments of the present invention including FL-25 having approximately 25 volume % binder (FIG. 15*a*), FL-30 having approximately 30 volume % binder (FIG. 15*b*), and FL-35 having approximately 35 volume % binder.
Figure 15B:
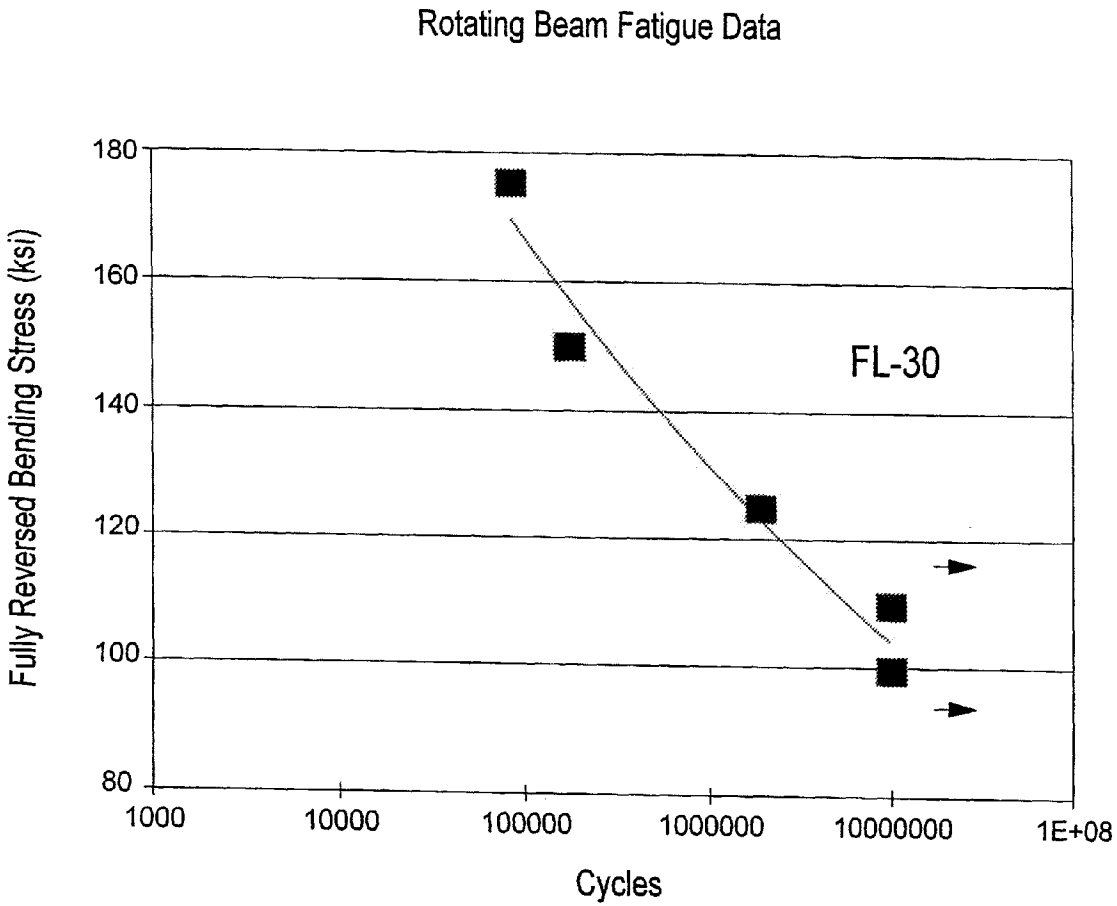
Figure 15C:
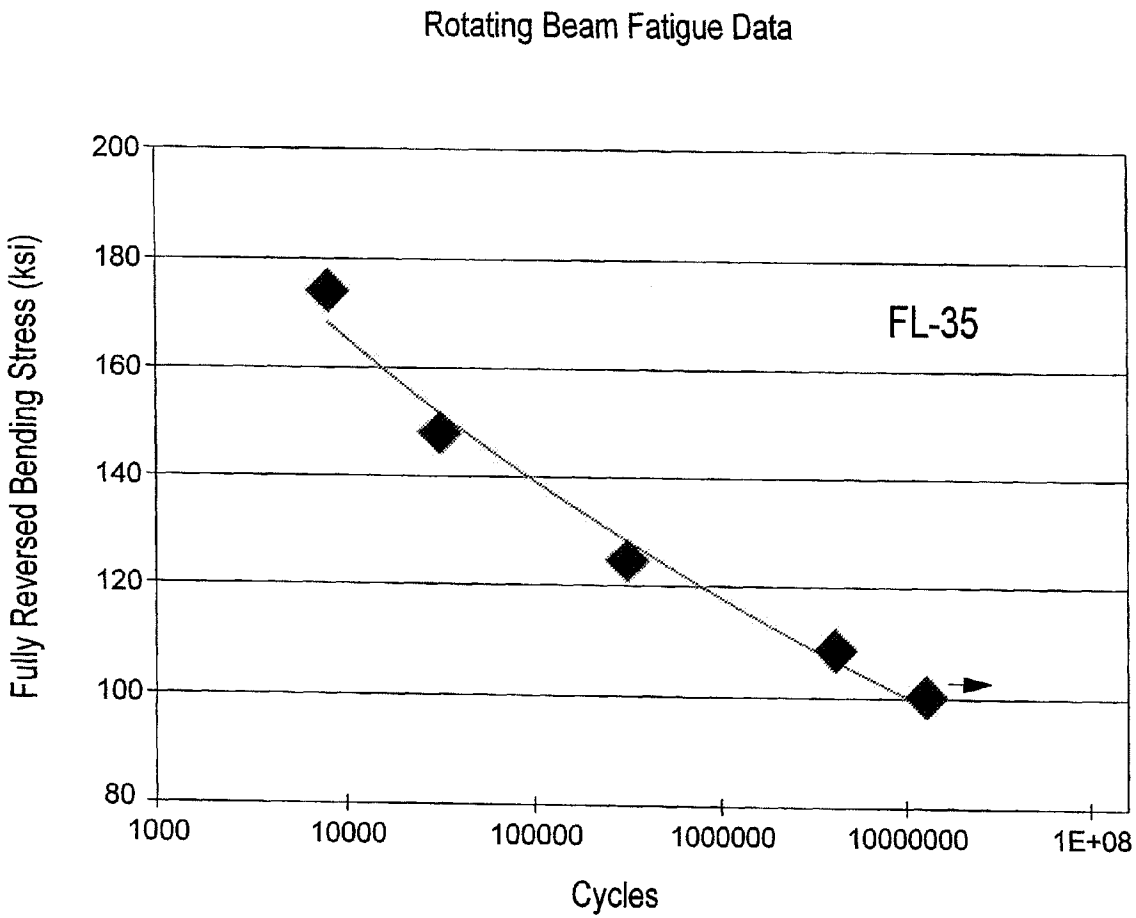

FIGS. 15*a*, 15*b* and 15*c* are graphs of fully reversed Rotating Beam Fatigue Data for test samples of compositions suitable for embodiments of the present invention listed in Table 1. As can be seen, test samples have a fully reversed bending stress of greater than 100 ksi at $(10)^7$ cycles.

Several properties of the body materials of the regions of earth-boring tools contribute to the service life of the tool. These properties of the body materials include, but may not be limited to, strength, stiffness, wear or abrasion resistance, and fatigue resistance. A bit body, roller cone, insert roller cone, or cone may comprise more than one region, each comprising different body materials. Strength is typically measured as a transverse rupture strength or ultimate tensile strength. Stiffness may be measured as a Young's modulus. The properties of embodiments of the present invention and prior art copper-based matrices are listed in Table 2. As can be seen, the embodiments of the present invention have TRS values greater than 250 ksi, in certain embodiments, the TRS may be greater than 300 ksi or even greater than 400 ksi. The Young's modulus of embodiments of the present invention exceed $55\times10^6$ psi and, preferably, for certain applications requiring greater stiffness, embodiments may have a Young's modulus of greater than $75\times10^6$ psi or even greater than $90\times10^6$ psi. In addition to the favorable TRS and Young's modulus values, embodiments of the present invention additionally comprise an increased hardness. Embodiments of the present invention may be tailored to have a hardness of greater than 65 HRA or by reducing the concentration of binder, for example, the hardness of specific embodiments may be increased to greater than 75 HRA or even greater than 85 HRA in certain embodiments.

The abrasion resistance, as measured according to ASTM B611, of embodiments of the body materials of the present invention may be greater than 1.0, or greater than 1.4. In certain applications or regions of the earth-boring tool, embodiments of the body materials of the present invention may have an abrasion resistance of from 2 to 14.

Embodiments of the present invention comprise body materials that also include combinations of properties that are applicable for the bit bodies, roller cones, insert roller cones, and cones. For example, embodiments of the present invention may comprise a body material having a transverse rupture strength greater than 200 ksi together, or greater than 250 ksi, with a Young's modulus greater than $40\times10^6$ psi. Other embodiments of the present invention may comprise a body material having a fatigue resistance greater than 30 ksi in combination with a Young's modulus greater than $30\times10^6$ psi. Such combinations of properties provide drilling articles that in certain applications will have a greater service life than conventional drilling articles.

TABLE 2

Comparison of Material Properties

| Property | Carbide 6%-16% Co | Carbide (FL-30) | Prior Art Matrix (Broad) | Test Method |
|---|---|---|---|---|
| Density, g/cm$^3$ | 13.94 to 14.95 | 12.70 | 10.0 to 13.5 | Standard |
| Wear | 2 to 14 | 1.47 | no data | ASTM B611-85 |
| TRS, ksi | 300 to 500 | 339 | 100 to 175 | ASTM B-406-96 |
| Compression, ksi | 400 to 800 | 388 | 136 to 225 | ASTM E0-89 |
| Proportional Limit, ksi | 125 to 350 | 69 | 28 to 54 | |
| Modulus, $\times10^6$ psi | 75 to 95 | 60 | 27 to 50 | ASTM E494-95 |
| Hardness | 84 to 92 HRA | 78 HRA | 10 to 50 HRC | ASTM B94-92 |

Additionally, certain embodiments of the composition of the present invention may comprise from 30 to 95 volume % of hard phase and from 5 to 70 volume % of binder phase. Isolated regions of the bit body may be within a broader range of hard phase concentrations from, for example, 30 to 99 volume % hard phase. This may be accomplished, for example, by disposing hard particles in various packing densities in certain locations within the mold or by placing cemented carbide inserts in the mold prior to casting the bit body or other article. Additionally, the bit body may be formed by casting more than one binder into the mold.

A difficulty with fabricating a bit body or holder comprising a binder including at least one of cobalt, iron, and nickel by an infiltration method stems from the relatively high melting points of cobalt, iron, and nickel. The melting point of each of these metals at atmospheric pressure is approximately 1500° C. In addition, since cobalt, iron, and nickel have high solubilities in the liquid state for tungsten carbide, it is difficult to prevent premature freezing of, for example, a molten cobalt-tungsten or nickel-tungsten carbide alloy while attempting to infiltrate a bed of tungsten carbide particles when casting an earth-boring bit body. This phenomenon may lead to the formation of pin-holes in the casting even with the use of high temperatures, such as greater than 1400° C., during the infiltration process.

Embodiments of the method of the present invention may overcome the difficulties associated with cobalt, iron and nickel infiltrated cast composites by use of a pre-alloyed cobalt-tungsten carbide eutectic or near-eutectic composition (30 to 60% tungsten carbide and 40 to 70% cobalt, by weight). For example, a cobalt alloy having a concentration of approximately 43 weight % of tungsten carbide has a melting point of approximately 1300° C. See FIG. 2. The lower melting point of the eutectic or near-eutectic alloy relative to cobalt, iron, and nickel, along with the negligible freezing range of the eutectic or near-eutectic composition, can greatly facilitate the fabrication of cobalt-tungsten carbide-based diamond bit bodies, as well as cemented carbide cones and roller cone bits. Eutectic or near-eutectic mixtures of cobalt-tungsten carbide, nickel-tungsten carbide, cobalt-nickel-tungsten carbide and iron-tungsten carbide alloys, for example, can be expected to exhibit far higher strength and toughness levels compared with brass- and bronze-based composites at equivalent abrasion/erosion-resistance levels. These alloys can also be expected to be machineable using conventional cutting tools.

Certain embodiments of the method of the invention comprise infiltrating a mass of hard particles with a binder that is a eutectic or near-eutectic composition comprising at least one of cobalt, iron, and nickel and tungsten carbide, and wherein the binder has a melting point less than 1350° C. As used herein, a near-eutectic concentration means that the concentrations of the major constituents of the composition are within 10 weight % of the eutectic concentrations of the constituents. The eutectic concentration of tungsten carbide in cobalt is approximately 43 weight percent. Eutectic compositions are known or easily approximated by one skilled in the art. Casting the eutectic or near-eutectic composition may be performed with or without hard particles in the mold. However, it may be preferable that upon solidification, the composition forms a precipitated hard tungsten carbide phase and a binder phase. The binder may further comprise alloying agents, such as at least one of boron, silicon, chromium, manganese, silver, aluminum, copper, tin, and zinc.

Embodiments of the present invention may comprise as one aspect the fabrication of bodies and cones from eutectic or near-eutectic compositions employing several different methods. Examples of these methods include:

1. Infiltrating a bed or mass of hard particles comprising a mixture of transition metal carbide particles and at least one of cobalt, iron, and nickel (i.e., a cemented carbide) with a molten infiltrant that is a eutectic or near-eutectic composition of a carbide and at least one of cobalt, iron, and nickel.

2. Infiltrating a bed or mass of transition metal carbide particles with a molten infiltrant that is a eutectic or near-eutectic composition of a carbide and at least one of cobalt, iron, and nickel.

3. Casting a molten eutectic or near-eutectic composition of a carbide, such as tungsten carbide, and at least one of cobalt, iron, and nickel to net-shape or a near-net-shape in the form of a bit body, roller cone, or cone.

4. Mixing powdered binder and hard particles together, placing the mixture in a mold, heating the powders to a temperature greater than the melting point of the binder, and cooling to cast the materials into the form of an earth-boring bit body, a roller cone, or a cone. This so-called "casting in place" method may allow the use of binders with relatively less capacity for infiltrating a mass of hard particles since the binder is mixed with the hard particles prior to melting and, therefore, shorter infiltration distances are required to form the article.

In certain methods of the present invention, infiltrating the hard particles may include loading a funnel with a binder, melting the binder, and introducing the binder into the mold with the hard particles and, optionally, the inserts. The binder as discussed above may be a eutectic or near-eutectic composition or may comprise at least one of cobalt, iron, and nickel and at least one melting point reducing constituent.

Another method of the present invention comprises preparing a mold and casting a eutectic or near-eutectic mixture of at least one of cobalt, iron, and nickel and a hard phase component. As the eutectic mixture cools, the hard phase may precipitate from the mixture to form the hard phase. This method may be useful for the formation of roller cones and teeth in tri-cone drill bits.

Another embodiment of the present invention involves casting in place, mentioned above. An example of this embodiment comprises preparing a mold, adding a mixture of hard particles and binder to the mold, and heating the mold above the melting temperature of the binder. This method results in the casting in place of the bit body, roller cone, and teeth for tri-cone drill bits. This method may be preferable when the expected infiltration distance of the binder is not sufficient for sufficiently infiltrating the hard particles conventionally.

The hard particles or hard phase may comprise one or more of carbides, oxides, borides, and nitrides, and the binder phase may be composed of one or more of the Group VIII metals, namely, Co, Ni, and/or Fe. The morphology of the hard phase can be in the form of irregular, equiaxed, or spherical particles, fibers, whiskers, platelets, prisms, or any other useful form. In certain embodiments, the cobalt, iron, and nickel alloys useful in this invention can contain additives, such as boron, chromium, silicon, aluminum, copper, manganese, or ruthenium, in total amounts up to 20 weight % of the ductile continuous phase.

Figure 2:
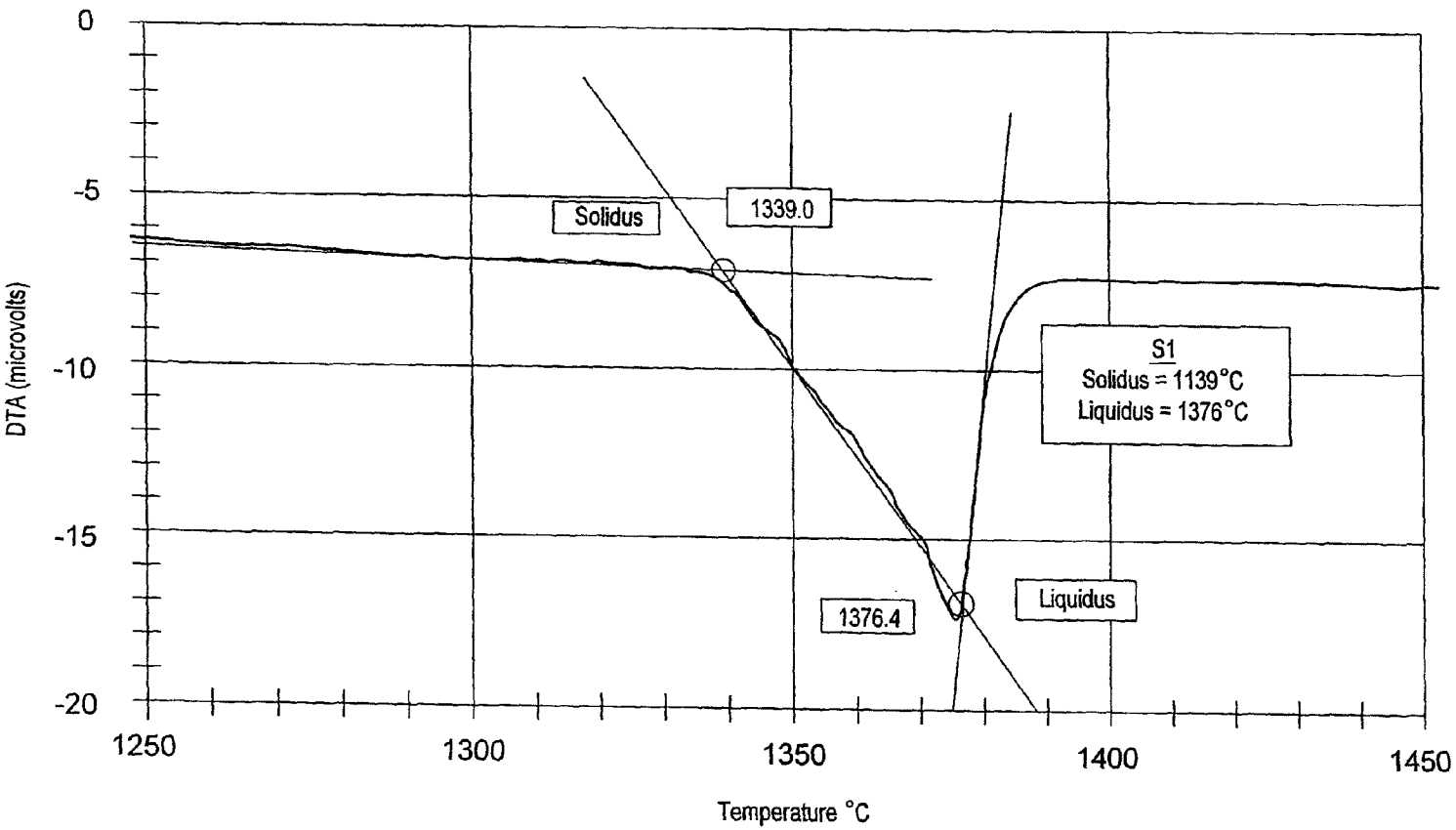
FIG. 2 is a graph of the results of a two-cycle DTA, from 900° C. to 1400° C. at a rate of temperature increase of 10° C./minute in an argon atmosphere, of a sample comprising about 45% tungsten carbide and about 55% cobalt.

FIGS. 2 through 8 are graphs of the results of Differential Thermal Analysis (DTA) on embodiments of the binders of the present invention. FIG. 2 is a graph of the results of a two-cycle DTA, from 900° C. to 1400° C. at a rate of temperature increase of 10° C./minute in an argon atmosphere, of a sample comprising about 45% tungsten carbide and about 55% cobalt (all percentages are in weight percent unless noted otherwise). The graph shows the melting point of the alloy to be approximately 1339° C.

Figure 3:
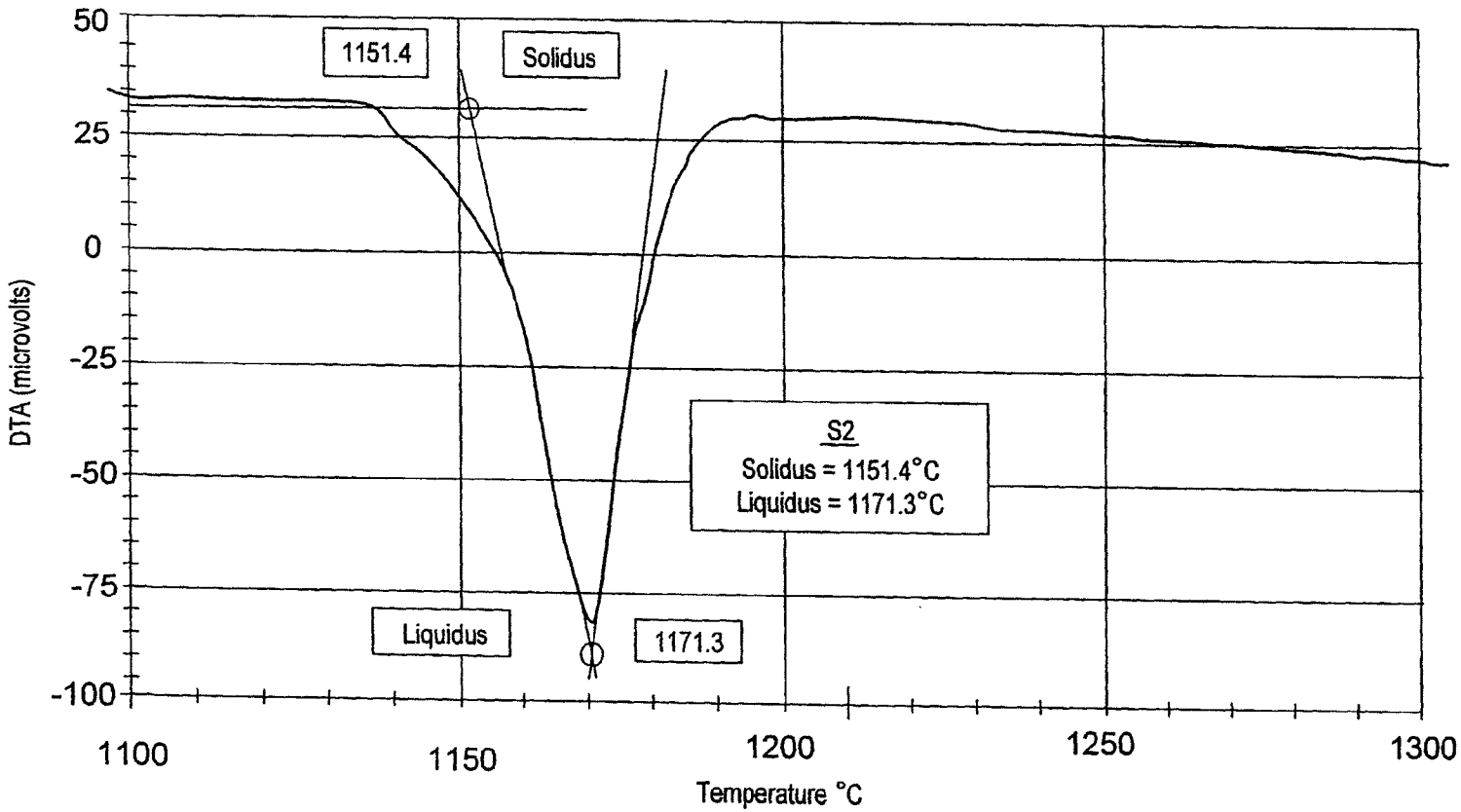
FIG. 3 is a graph of the results of a two-cycle DTA, from 900° C. to 1300° C. at a rate of temperature increase of 10° C./minute in an argon atmosphere, of a sample comprising about 45% tungsten carbide, about 53% cobalt, and about 2% boron.

FIG. 3 is a graph of the results of a two-cycle DTA, from 900° C. to 1300° C. at a rate of temperature increase of 10° C./minute in an argon atmosphere, of a sample comprising about 45% tungsten carbide, about 53% cobalt, and about 2% boron. The graph shows the melting point of the alloy to be approximately 1151° C. As compared to the DTA of the alloy of FIG. 2, the replacement of about 2% of cobalt with boron reduced the melting point of the alloy in FIG. 3 almost 200° C.

Figure 4:
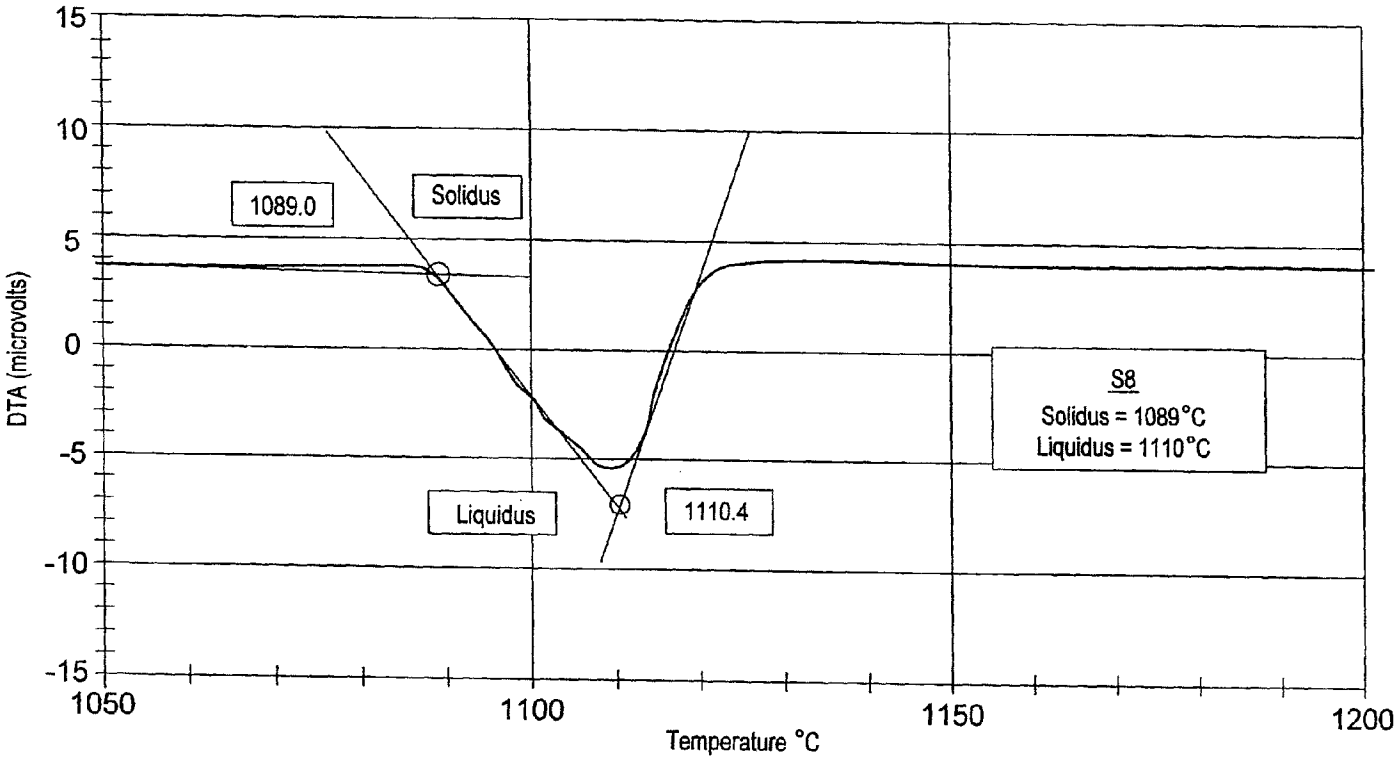
FIG. 4 is a graph of the results of a two-cycle DTA, from 900° C. to 1400° C. at a rate of temperature increase of 10° C./minute in an argon atmosphere, of a sample comprising about 45% tungsten carbide, about 53% nickel, and about 2% boron.

FIG. 4 is a graph of the results of a two-cycle DTA, from 900° C. to 1400° C. at a rate of temperature increase of 10° C./minute in an argon atmosphere, of a sample comprising about 45% tungsten carbide, about 53% nickel, and about 2% boron. The graph shows the melting point of the alloy to be approximately 1089° C. As compared to the DTA of the alloy of FIG. 3, the replacement of cobalt with nickel reduced the melting point of the alloy in FIG. 4 almost 60° C.

Figure 5:
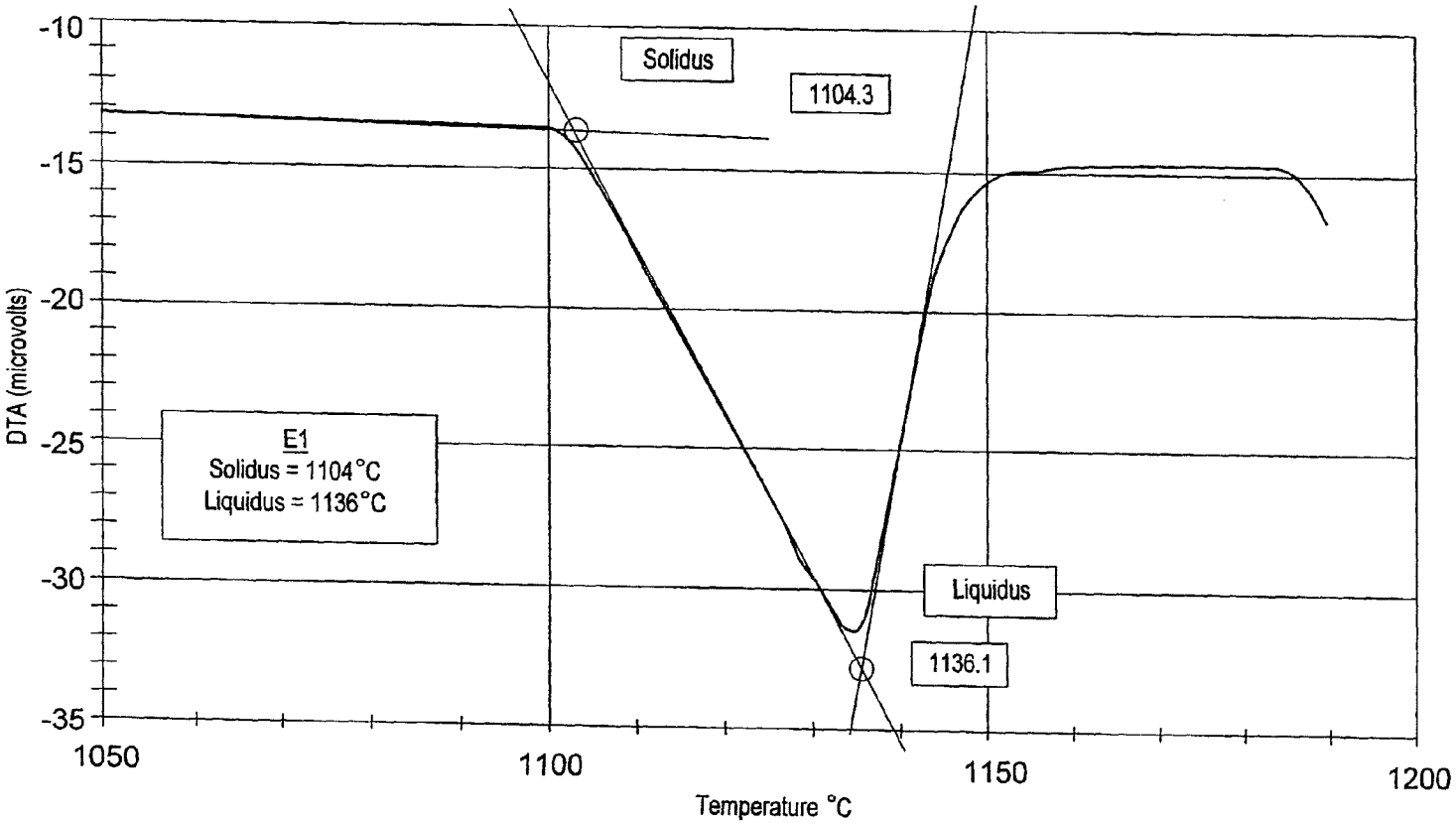
FIG. 5 is a graph of the results of a two-cycle DTA, from 900° C. to 1200° C. at a rate of temperature increase of 10° C./minute in an argon atmosphere, of a sample comprising about 96.3% nickel and about 3.7% boron.

FIG. 5 is a graph of the results of a two-cycle DTA, from 900° C. to 1200° C. at a rate of temperature increase of 10° C./minute in an argon atmosphere, of a sample comprising about 96.3% nickel and about 3.7% boron. The graph shows the melting point of the alloy to be approximately 1100° C.

Figure 6:
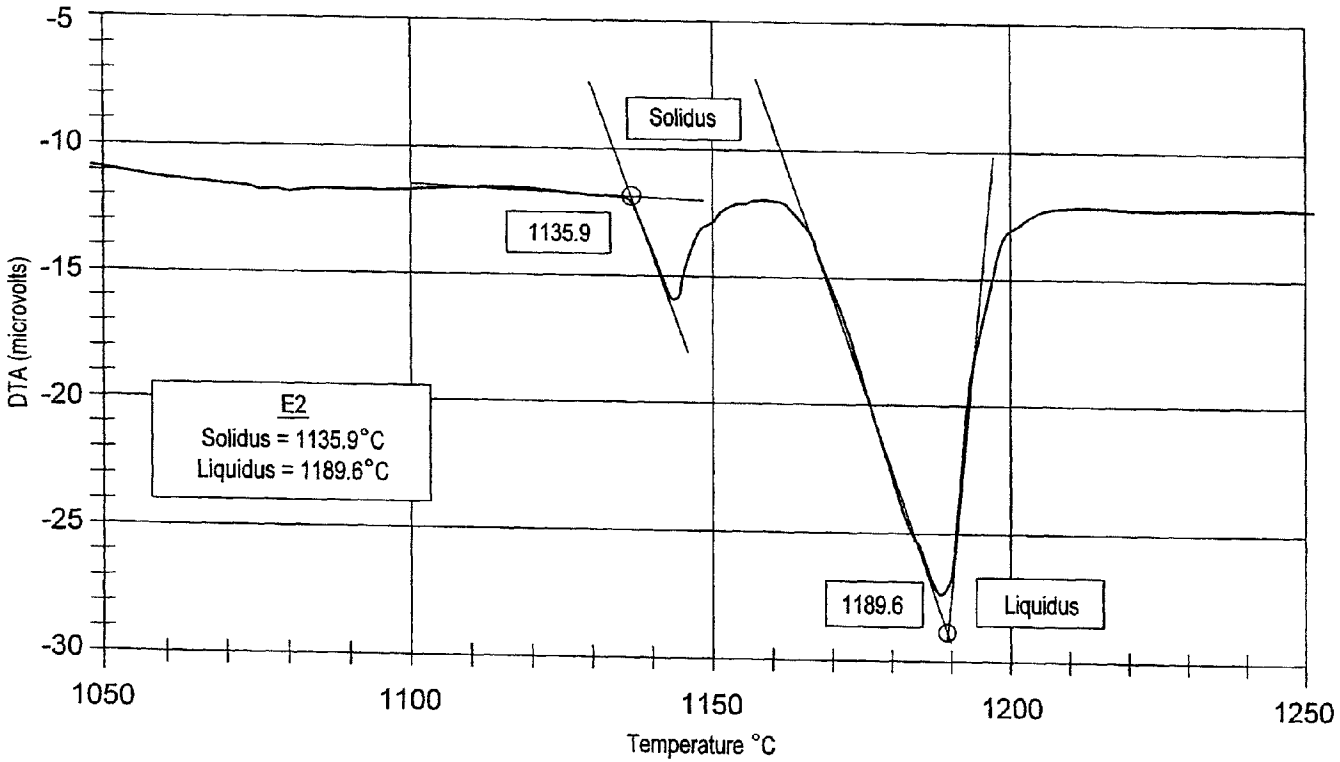
FIG. 6 is a graph of the results of a two-cycle DTA, from 900° C. to 1300° C. at a rate of temperature increase of 10° C./minute in an argon atmosphere, of a sample comprising about 88.4% nickel and about 11.6% silicon.

FIG. 6 is a graph of the results of a two-cycle DTA, from 900° C. to 1300° C. at a rate of temperature increase of 10° C./minute in an argon atmosphere, of a sample comprising about 88.4% nickel and about 11.6% silicon. The graph shows the melting point of the alloy to be approximately 1150° C.

Figure 7:
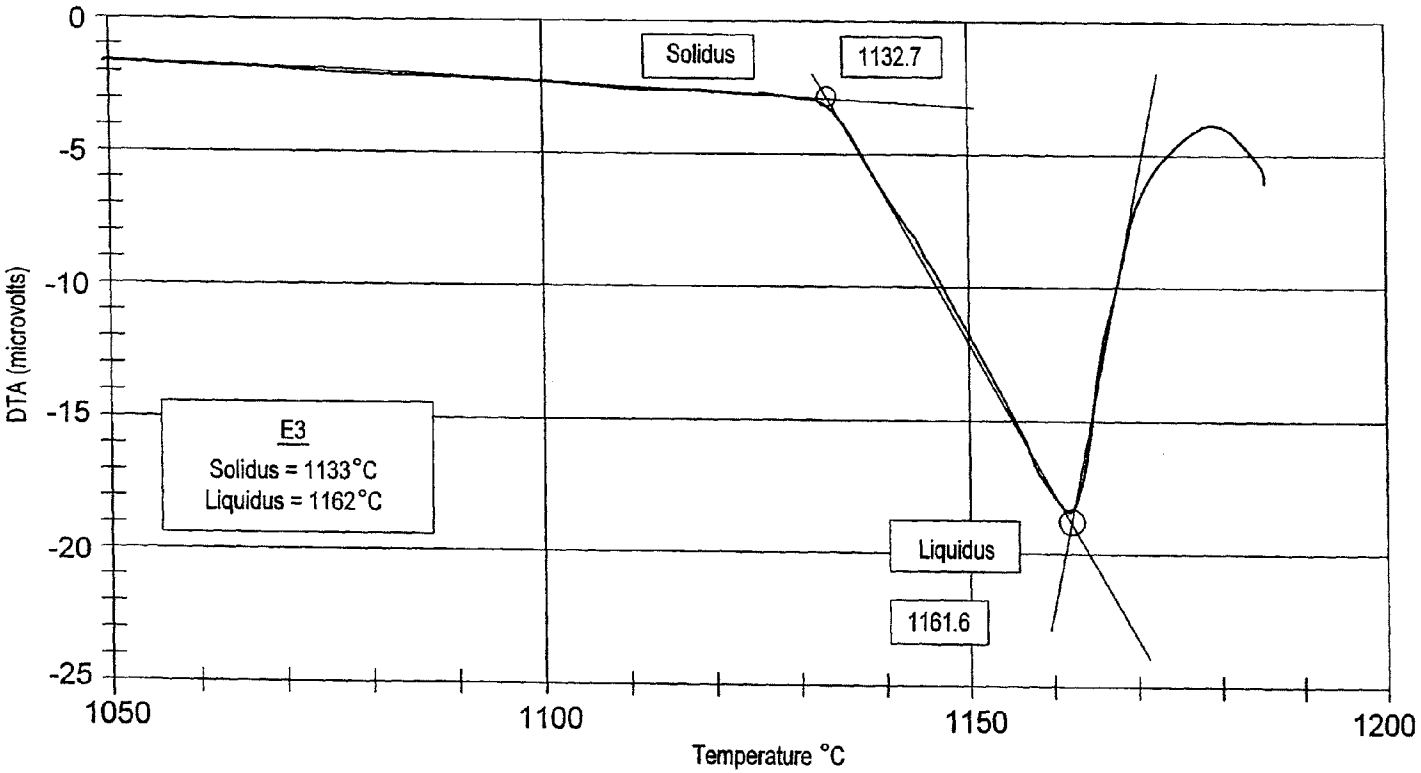
FIG. 7 is a graph of the results of a two-cycle DTA, from 900° C. to 1200° C. at a rate of temperature increase of 10° C./minute in an argon atmosphere, of a sample comprising about 96% cobalt and about 4% boron.

FIG. 7 is a graph of the results of a two-cycle DTA, from 900° C. to 1200° C. at a rate of temperature increase of 10° C./minute in an argon atmosphere, of a sample comprising about 96% cobalt and about 4% boron. The graph shows the melting point of the alloy to be approximately 1100° C.

Figure 8:
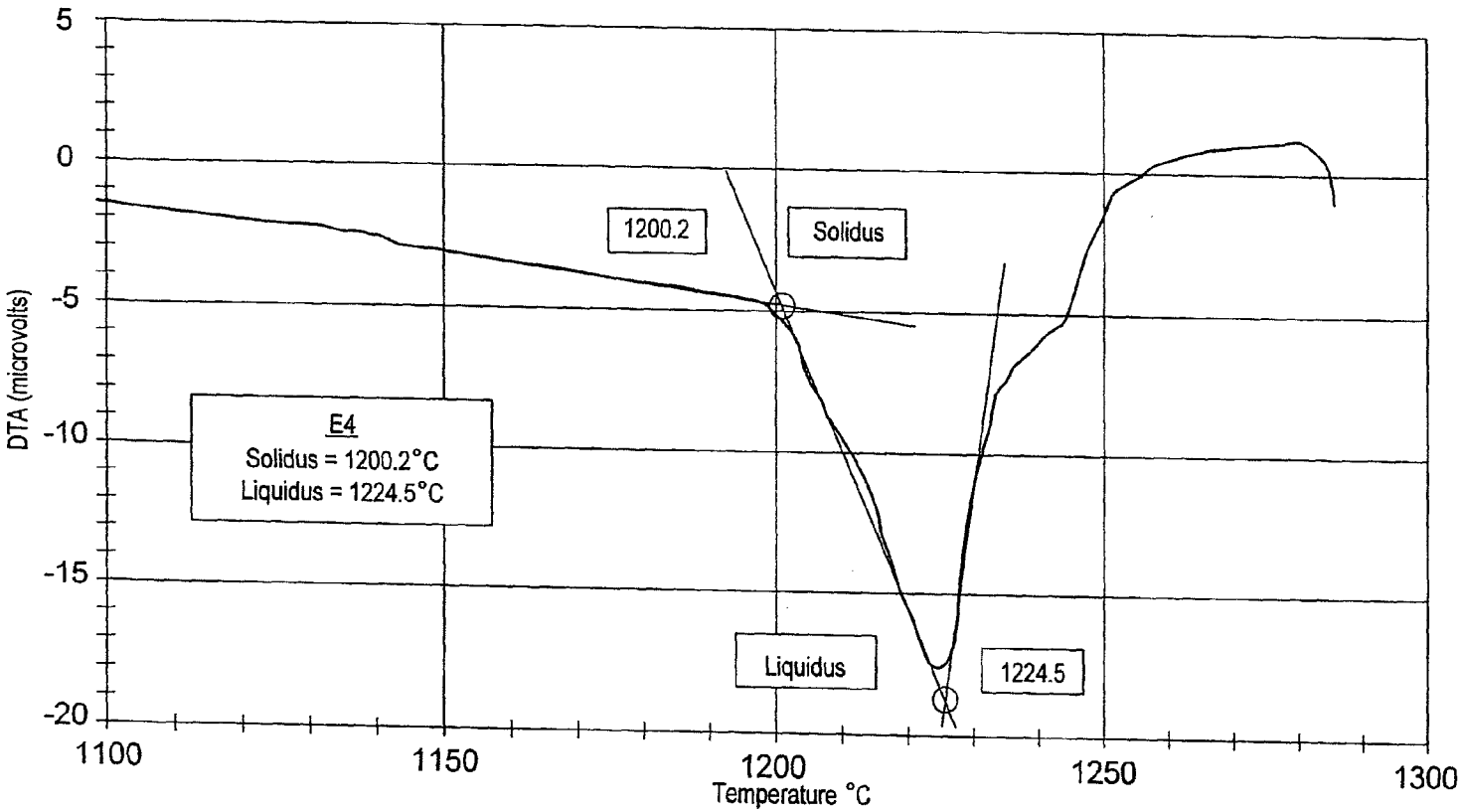
FIG. 8 is a graph of the results of a two-cycle DTA, from 900° C. to 1300° C. at a rate of temperature increase of 10° C./minute in an argon atmosphere, of a sample comprising about 87.5% cobalt and about 12.5% silicon.

FIG. 8 is a graph of the results of a two-cycle DTA, from 900° C. to 1300° C. at a rate of temperature increase of 10° C./minute in an argon atmosphere, of a sample comprising about 87.5% cobalt and about 12.5% silicon. The graph shows the melting point of the alloy to be approximately 1200° C.

Figure 9:
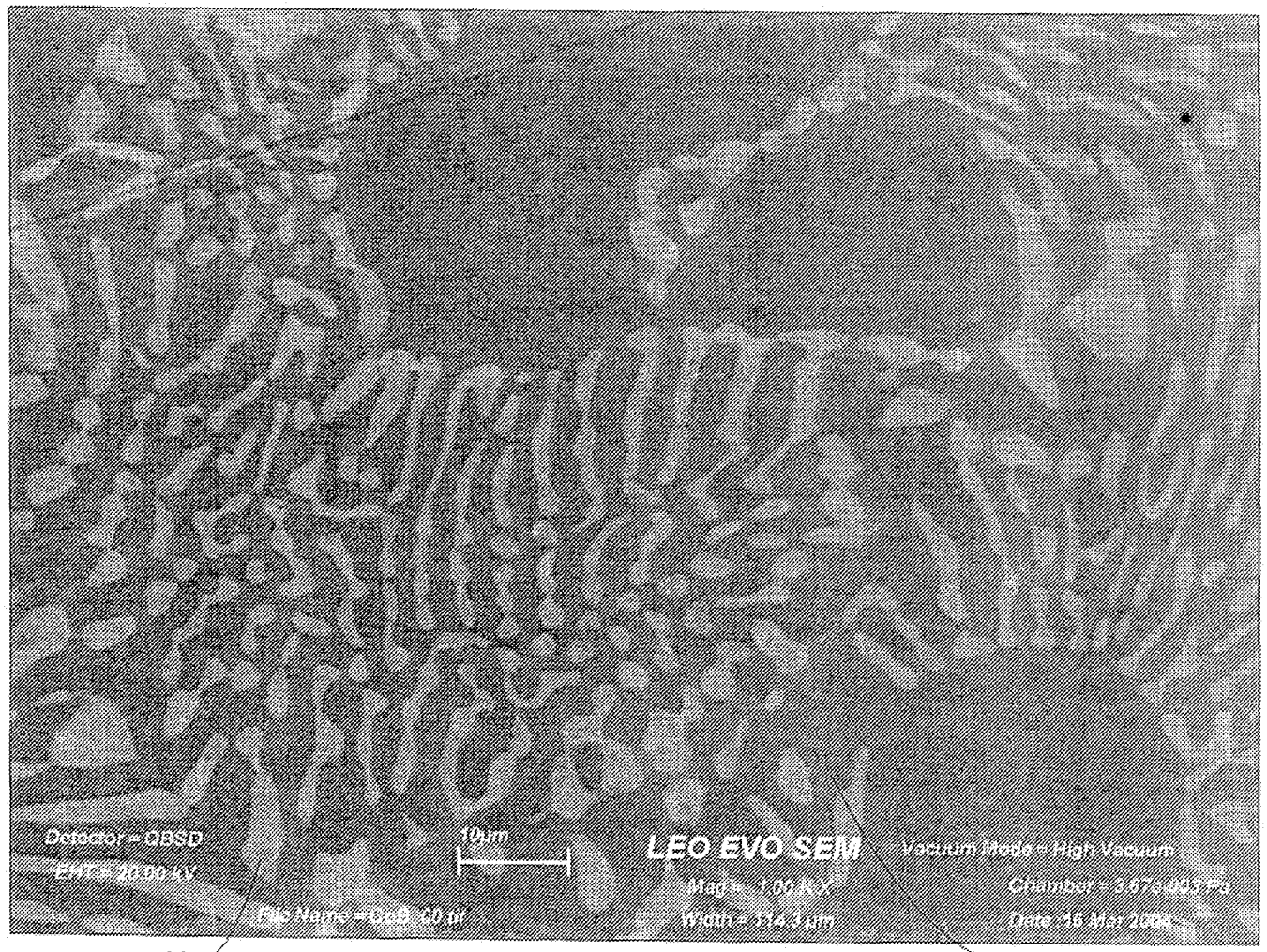
FIG. 9 is a scanning electron microscope (SEM) photomicrograph of a material produced by infiltrating a mass of hard particles with a binder consisting essentially of cobalt and boron.
Figure 10:
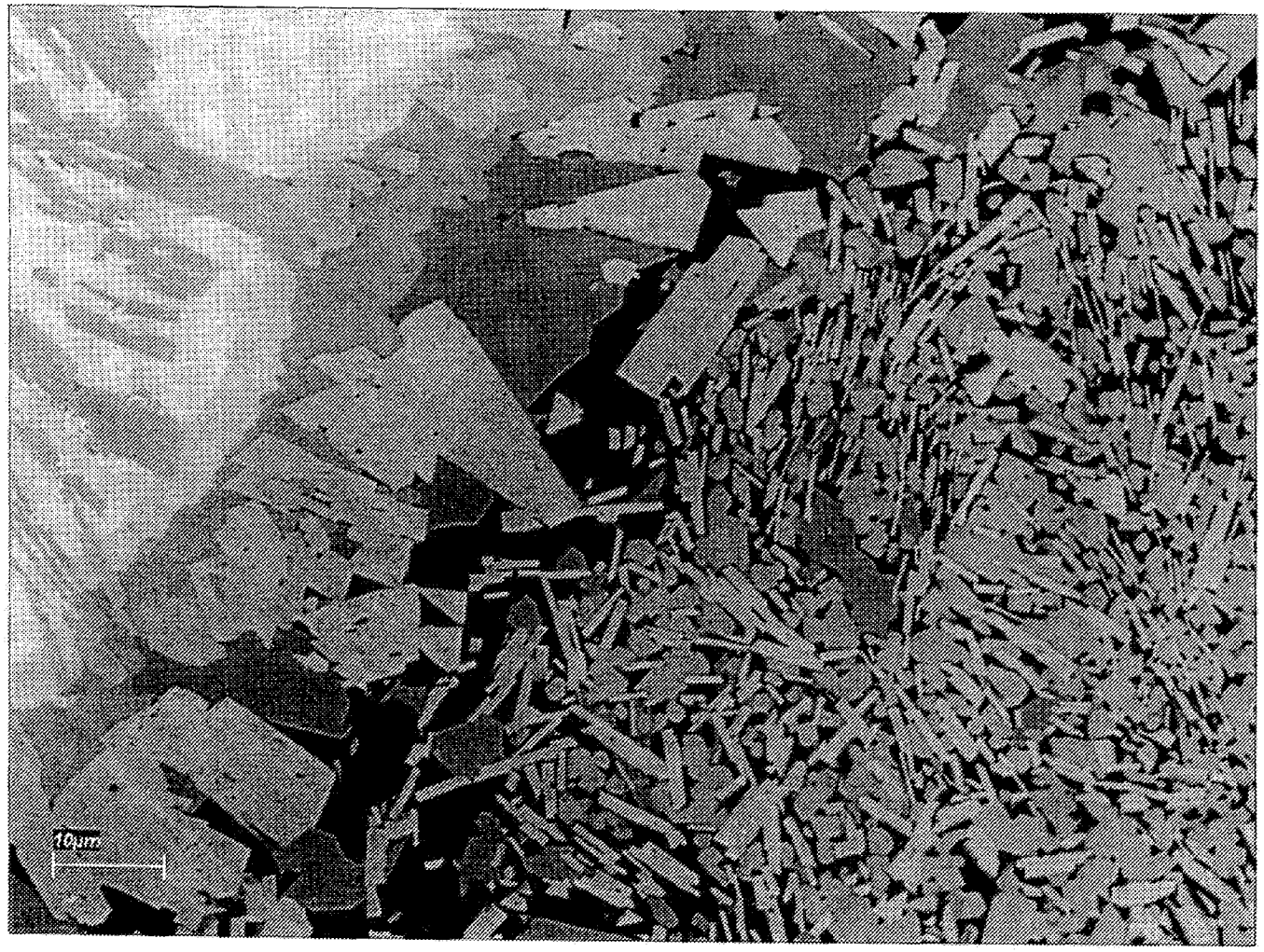
FIG. 10 is an SEM photomicrograph of a material produced by infiltrating a mass of hard particles with a binder consisting essentially of cobalt and boron.
Figure 11:
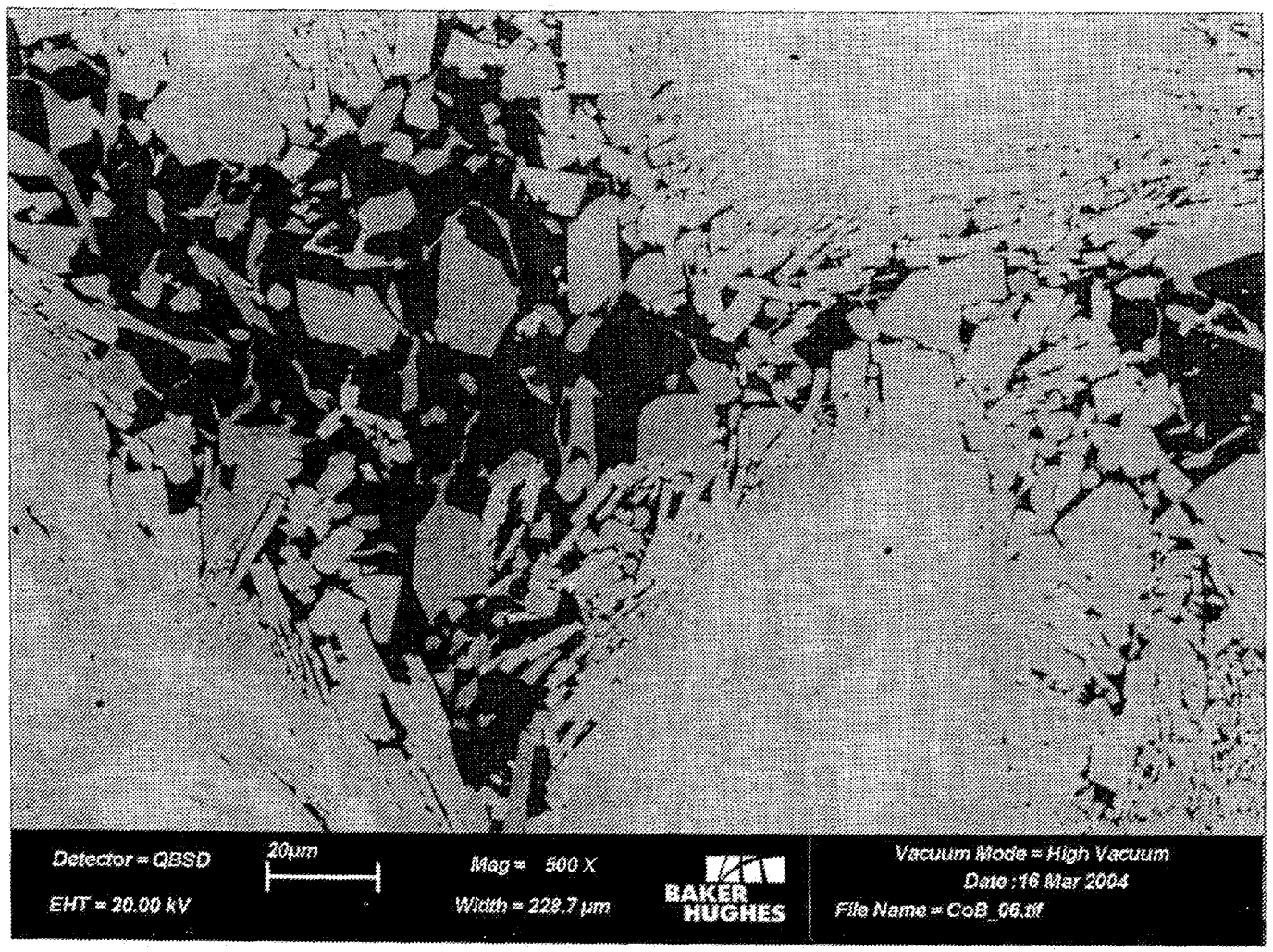
FIG. 11 is an SEM photomicrograph of a material produced by infiltrating a mass of hard particles with a binder consisting essentially of cobalt and boron.

FIGS. 9 through 11 show photomicrographs of materials formed by embodiments of the methods of the present invention. FIG. 9 is a scanning electron microscope (SEM) photomicrograph of a material produced by casting a binder consisting essentially of a eutectic mixture of cobalt and boron, wherein the boron is present at about 4 weight percent of the binder. The lighter colored phase 92 is $Co_3B$ and the darker phase 91 is essentially cobalt. The cobalt and boron mixture was melted by heating to approximately 1200° C. and then allowed to cool in air to room temperature and solidify.

Figure 12:
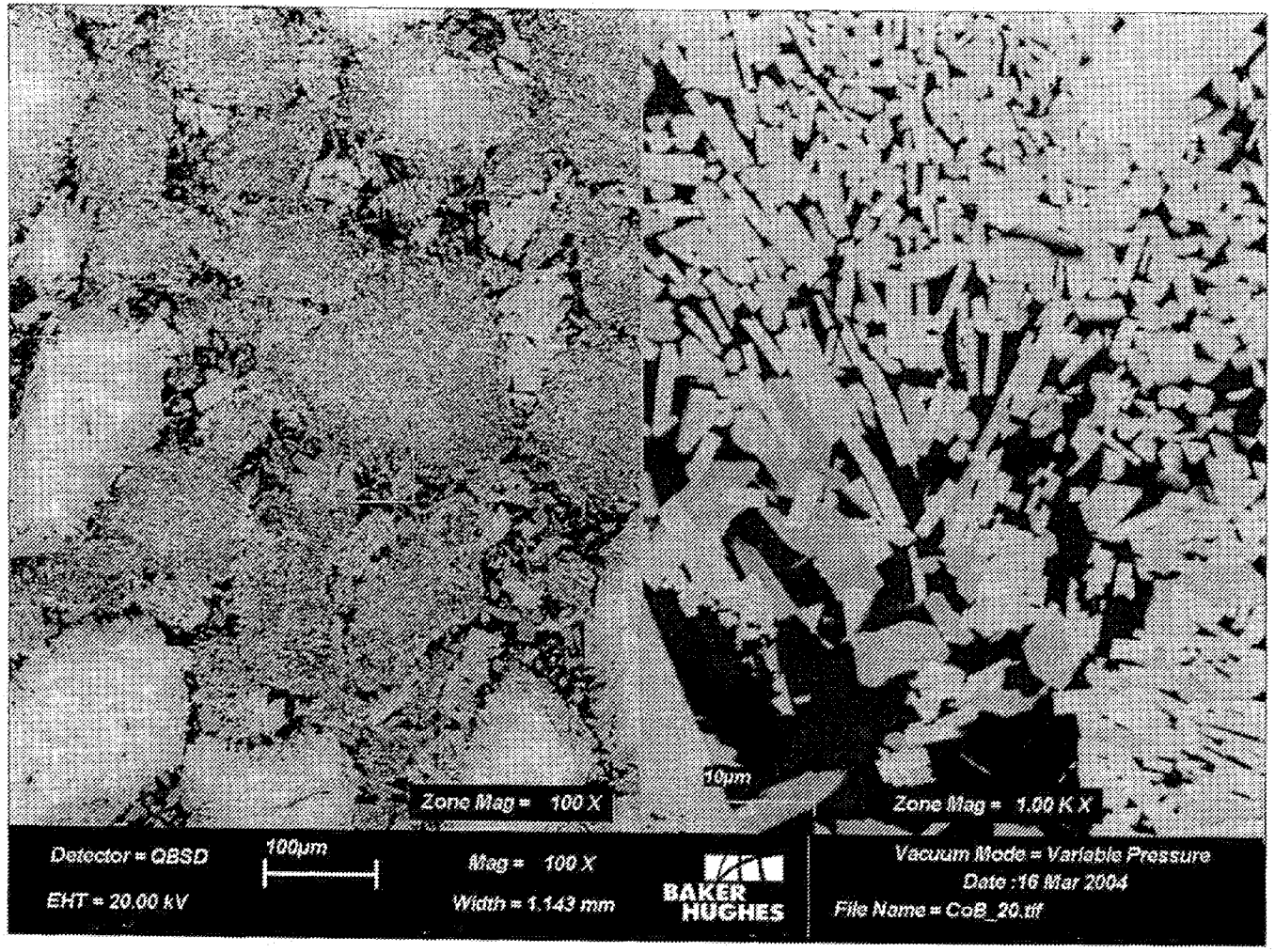
FIG. 12 is an SEM photomicrograph of a material produced by infiltrating a mass of hard particles with a binder consisting essentially of cobalt and boron.

FIGS. 10 through 12 are SEM photomicrographs of different pieces and different aspects of the microstructure made from the same material. The material was formed by infiltrating hard particles with a binder. The hard particles were a cast carbide aggregate ($W_2C$, WC) comprising approximately 60-65 volume percent of the material. The aggregate was infiltrated by a binder comprising approximately 96 weight percent cobalt and 4 weight percent boron. The infiltration temperature was approximately 1285° C.

Figure 13:
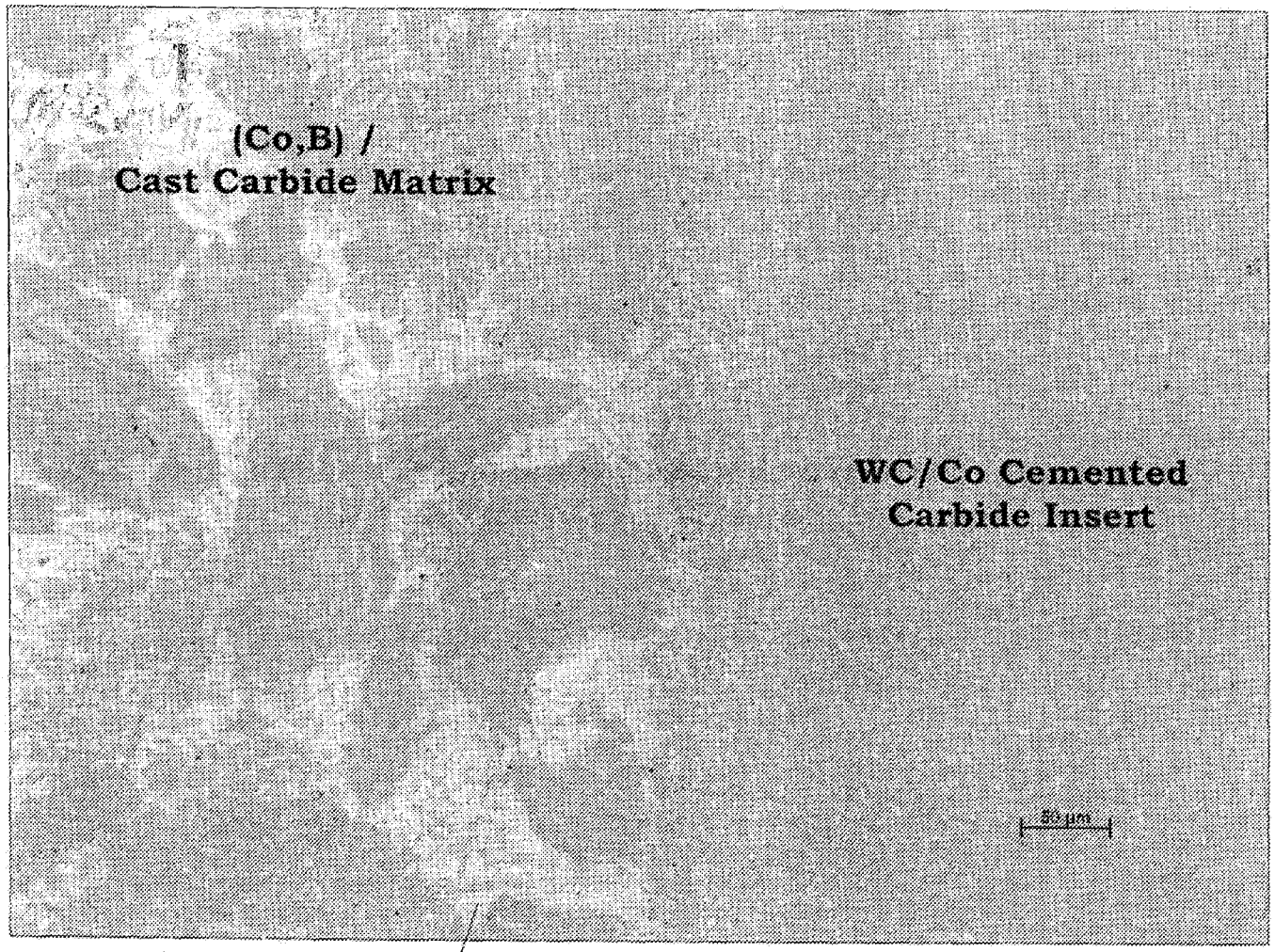
FIG. 13 is a photomicrograph of a material produced by infiltrating a mass of cast carbide particles and a cemented carbide insert with a binder consisting essentially of cobalt and boron.

FIG. 13 is a photomicrograph of a material produced by infiltrating a mass of cast carbide particles 130 and a cemented carbide insert 131 with a binder consisting essentially of cobalt and boron. To produce the material shown in FIG. 13, a cemented carbide insert 131 of approximately ¾-inch diameter by 1.5-inch height was placed in the mold prior to infiltrating the mass of hard cast carbide particles 130 with a binder comprising cobalt and boron. As may be seen in FIG. 13, the infiltrated binder and the binder of the cemented carbide blended to form one continuous matrix 132, binding both the cast carbides and the carbides of the cemented carbide.

Figure 16:
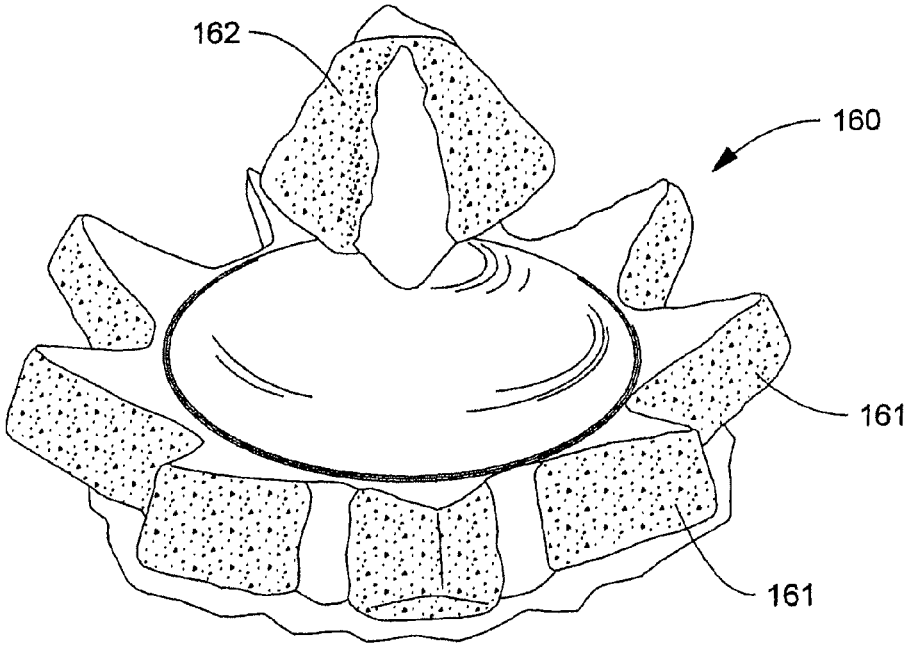
FIG. 16 is a representation of an embodiment of a roller cone of the present invention.

In addition, hardfacing may be added to embodiments of the present invention. Hardfacing may be added on bit bodies, roller cones, insert roller cones, and cones wherever increased wear resistance is desired. For example, roller cone 160, as shown in FIG. 16, may comprise a hardfacing on the plurality of teeth 161 and the spear point 162. A bit body for the roller cone 160 may also comprise hardfacing, such as in a region surrounding any nozzles. Referring to FIG. 14, the bit body 140 may comprise hardfacing in the nozzle outlet regions 144, gage pad 143, and insert pocket regions 141, for example. A typical hardfacing material comprises tungsten carbide in an alloy steel matrix.

It is to be understood that the present description illustrates those aspects of the invention relevant to a clear understanding of the invention. Certain aspects of the invention that would be apparent to those of ordinary skill in the art and that, therefore, would not facilitate a better understanding of the invention, have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

The invention claimed is:

1. A method comprising:

consolidating metallurgical powder to form a green billet, wherein the metallurgical powder comprises:

a plurality of hard particles selected from the group consisting of carbides, nitrides, borides, silicides, oxides, and solid solutions thereof; and a binder material comprising:

a metal selected from the group consisting of cobalt, nickel, iron, and alloys thereof; and at least one melting point reducing constituent;

selecting the at least one melting point reducing constituent to comprise at least one of a transition metal carbide up to 60 weight percent, a transition metal boride up to 60 weight percent, a transition metal silicide up to 60 weight percent, a transition metal up to 50 weight percent, boron up to 10 weight percent, silicon up to 20 weight percent, chromium up to 20 weight percent, and manganese up to 25 weight percent, wherein the weight percentages are based on the total weight of the binder; and forming a fixed cutter bit body substantially comprised of a composite material from the green billet.

2. The method of claim 1, further comprising disposing a cutting insert into a pocket defined by the formed fixed cutter bit body.

3. The method of claim 1, wherein forming the fixed cutter bit body comprises:

presintering the green billet to form a brown billet; and sintering the brown billet.

4. The method of claim 3, further comprising machining the brown billet prior to sintering the brown billet.

5. The method of claim 4, further comprising machining the green billet prior to presintering the green billet.

6. The method of claim 3, further comprising machining the green billet prior to presintering.

7. The method of claim 6, wherein machining comprises machining one or more cutter insert pockets in the green billet.

8. The method of claim 1, wherein consolidating the metallurgical powder comprises pressing the metallurgical powder.

9. The method of claim 8, wherein pressing the metallurgical powder comprises isostatically pressing the metallurgical powder.

10. The method of claim 1, wherein the plurality of hard particles comprises a transition metal carbide selected from the group consisting of titanium carbide, chromium carbide, vanadium carbide, zirconium carbide, hafnium carbide, tantalum carbide, molybdenum carbide, niobium carbide, and tungsten carbide.

11. The method of claim 3, wherein sintering the brown billet comprises sintering the brown billet at a liquid phase temperature.

12. The method of claim 3, wherein sintering the brown billet comprises sintering the brown billet at a pressure of 300 to 2000 psi and a temperature of 1350° C. to 1500° C.

13. The method of claim 1, wherein the consolidated metallurgical powder of the green billet comprises a first region having a first composition and a second region having a second composition.

14. The method of claim 13, further comprising, prior to consolidating the metallurgical powder:

placing the first composition of the metallurgical powder into a first region of a void of a mold for the green billet; and placing the second composition of the metallurgical powder into a second region of the void.

15. The method of claim 1, further comprising attaching a shank to the fixed cutter bit body.

16. The method of claim 4, wherein machining comprises machining one or more cutter insert pockets in the brown billet.

17. The method of claim 1, wherein the formed fixed cutter bit body has a transverse rupture strength greater than 300 ksi.

18. The method of claim 17, wherein the formed fixed cutter bit body has a Young's modulus greater than 55,000,000 psi.

19. A method comprising:

consolidating metallurgical powder to form a powder consolidate, wherein the metallurgical powder comprises:

a plurality of hard particles selected from the group consisting of carbides, nitrides, borides, silicides, oxides, and solid solutions thereof, and a binder material comprising a metal selected from the group consisting of cobalt, nickel, iron, and alloys thereof; formulating the binder material to have a melting point in the range of 1050° C. to 1350° C.; and forming a fixed cutter bit body substantially comprised of a composite material from the powder consolidate, wherein forming comprises at least one step of sintering the powder consolidate.

20. The method of claim 19, further comprising disposing a cutting insert into a pocket defined by the formed fixed cutter bit body.

21. The method of claim 19, wherein forming the fixed cutter bit body comprises:

presintering the powder consolidate to form a brown billet; and sintering the brown billet.

22. The method of claim 21, further comprising machining the brown billet prior to sintering the brown billet.

23. The method of claim 22, further comprising machining the powder consolidate prior to presintering the green billet.

24. The method of claim 21, further comprising machining the powder consolidate prior to presintering.

25. The method of claim 19, wherein consolidating the metallurgical powder comprises pressing the metallurgical powder.

26. The method of claim 25, wherein pressing the metallurgical powder comprises isostatically pressing the metallurgical powder.

27. The method of claim 19, wherein the plurality of hard particles comprises a transition metal carbide selected from the group consisting of titanium carbide, chromium carbide, vanadium carbide, zirconium carbide, hafnium carbide, tantalum carbide, molybdenum carbide, niobium carbide, and tungsten carbide.

28. The method of claim 21, wherein sintering the brown billet comprises sintering the brown billet at a liquid phase temperature.

29. The method of claim 21, wherein sintering the brown billet comprises sintering the brown billet at a pressure of 300 to 2000 psi and a temperature of 1350° C. to 1500° C.

30. The method of claim 19, wherein the consolidated metallurgical powder of the powder consolidate comprises a first region having a first composition and a second region having a second composition.

31. The method of claim 30, further comprising, prior to consolidating the metallurgical powder:

placing the first composition of the metallurgical powder into a first region of a void of a mold; and placing the second composition of the metallurgical powder into a second region of the void.

32. The method of claim 19, further comprising attaching a shank to the fixed cutter bit body.

33. The method of claim 22, wherein machining comprises machining one or more cutter insert pockets in the brown billet.

34. The method of claim 19, wherein the formed fixed cutter bit body has a transverse rupture strength greater than 300 ksi.

35. The method of claim 34, wherein the formed fixed cutter bit body has a Young's modulus greater than 55,000,000 psi.

* * * * *

UNITED STATES PATENT AND TRADEMARK OFFICE

CERTIFICATE OF CORRECTION

PATENT NO. : 8,007,714 B2
APPLICATION NO. : 12/033960
DATED : August 30, 2011
INVENTOR(S) : Mirchandani et al.

It is certified that error appears in the above-identified patent and that said Letters Patent is hereby corrected as shown below:

On the title page:

In ITEM (56):

U.S. PATENT DOCUMENTS

Page 2, column 1, line 68 change “Kalayama” to --Katayama--

In the specification:

COLUMN 6, LINE 57, change “and second” to --and a second--

COLUMN 14, LINE 53, change “carbide blended” to --carbide are blended--

Signed and Sealed this
Seventeenth Day of February, 2015

Michelle K. Lee

Michelle K. Lee
*Deputy Director of the United States Patent and Trademark Office*